US007773893B2

(12) United States Patent
Wagatsuma

(10) Patent No.: US 7,773,893 B2
(45) Date of Patent: Aug. 10, 2010

(54) IMAGE FORMING APPARATUS

(75) Inventor: Eiji Wagatsuma, Tokyo (JP)

(73) Assignee: Oki Data Corporation, Tokyo (JP)

( * ) Notice: Subject to any disclaimer, the term of this patent is extended or adjusted under 35 U.S.C. 154(b) by 397 days.

(21) Appl. No.: 12/021,592

(22) Filed: Jan. 29, 2008

(65) Prior Publication Data

US 2008/0181644 A1 Jul. 31, 2008

(30) Foreign Application Priority Data

Jan. 31, 2007 (JP) ..... 2007-022391

(51) Int. Cl.
*G03G 15/20* (2006.01)

(52) U.S. Cl. ..... 399/33

(58) Field of Classification Search ..... 399/33, 399/21, 22, 23, 69, 320, 322, 323
See application file for complete search history.

(56) References Cited

U.S. PATENT DOCUMENTS 5,517,284 A * 5/1996 Ohtake et al. ..... 399/69
5,794,096 A * 8/1998 Okabayashi ..... 399/33
5,895,152 A * 4/1999 Ide et al. ..... 399/322
6,032,016 A * 2/2000 Morigami et al. ..... 399/325
2005/0180768 A1 8/2005 Inoue
2006/0008286 A1 * 1/2006 Nihonyanagi et al. ..... 399/69

FOREIGN PATENT DOCUMENTS

JP 2000-305408 A 11/2000
JP 2001-109319 A 4/2001
JP 2005345540 A 12/2005

* cited by examiner

*Primary Examiner*—David P Porta
*Assistant Examiner*—Kiho Kim
(74) *Attorney, Agent, or Firm*—Panitch Schwarze Belisario & Nadel LLP

(57) ABSTRACT

A printer is provided that is capable of accurately detecting whether a recording medium is remaining even where a temperature changes rapidly. The printer has a fusing unit rotating to fuse a developer attached to a recording medium P onto the recording medium P with heat, a heater applying heat to the fusing unit, a temperature detection element detecting a temperature of the fusing unit heated by the heater, a timer measuring a time duration, a temperature gradient calculation unit calculating a temperature gradient of change in the temperature of the fusing unit based on a detection result of the temperature of the fusing unit detected by the temperature detection element, and a CPU determining whether the recording medium P is remaining on the fusing unit based on the temperature gradient calculated by the temperature gradient calculation unit and a time duration of the temperature gradient measured by the timer.

12 Claims, 25 Drawing Sheets

IMAGE FORMING APPARATUS

BACKGROUND OF THE INVENTION

1. Field of the Invention

This invention relates to an image forming apparatus.

2. Description of Related Art

A conventional image forming apparatus has a fusing device fusing a developer image attached to a recording medium such as paper with heat applied to a fusing unit by a heat source. Where the paper wraps around the fusing unit during fusing due to some causes, the conventional image forming apparatus determines whether the paper wraps around the fusing unit based on the change in a temperature gradient of the fusing unit. Specifically, the conventional image forming apparatus determines that the paper wraps around the fusing unit where a temperature detection unit near the fusing unit detects a temperature equal to or less than a certain reference temperature or where a temperature gradient generated based on the temperature detected by the temperature detection unit exceeds a certain temperature gradient reference value. Un-examined Japanese patent application publication No. 2001-109319 describes such an image forming apparatus.

With the image forming apparatus thus structured, however, the temperature detection unit detects an abnormal temperature gradient where the temperature changes rapidly in a short time in a manner of spike noise due to occurrences of rapid changes in the fusing temperature. There raises a problem that the fusing device detects the remaining paper when detecting such an abnormal temperature gradient.

BRIEF SUMMARY OF THE INVENTION

This invention is made in consideration of the above problem, and it is the object of the present invention to provide an image forming apparatus capable of accurately detecting remaining paper even in cases such as where the temperature changes rapidly.

An image forming apparatus of the present invention has a fusing unit fusing a developer image attached to a recording medium onto said recording medium with heat, a heat source applying heat to said fusing unit, a fusing temperature detection unit detecting a temperature of said fusing unit heated by said heat source, a time measuring unit measuring a time duration, a temperature gradient calculation unit calculating a temperature gradient value of change in the temperature of said fusing unit based on a detection result of the temperature of said fusing unit detected by said fusing temperature detection unit, and a remaining determination unit determining whether said recording medium remains in said fusing device based on the temperature gradient value calculated by said temperature gradient calculation unit and the time duration of the temperature gradient value measured by said time measuring unit.

Such a structure enables the image forming apparatus of the present invention to take into consideration not only the temperature gradient but also the time duration to determine whether the recording medium is remaining. That is, the image forming apparatus takes the time duration into consideration and looks up the temperature gradient, thus being capable of avoiding incorrectly determining that the paper is remaining even where a rapid temperature change such as spike noise occurs.

The image forming apparatus of the present invention can accurately detects remaining paper even in cases such as where a rapid temperature change occurs.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The image forming apparatus of the present invention is hereinafter described with reference to the figures. It should be understood that the image forming apparatus of the present invention is not limited to embodiments described below, and can be modified as necessary within the scope of the spirit of the invention.

An electrophotographic color printer is described in the below embodiments as an example of the image forming apparatus.

Figure 1:
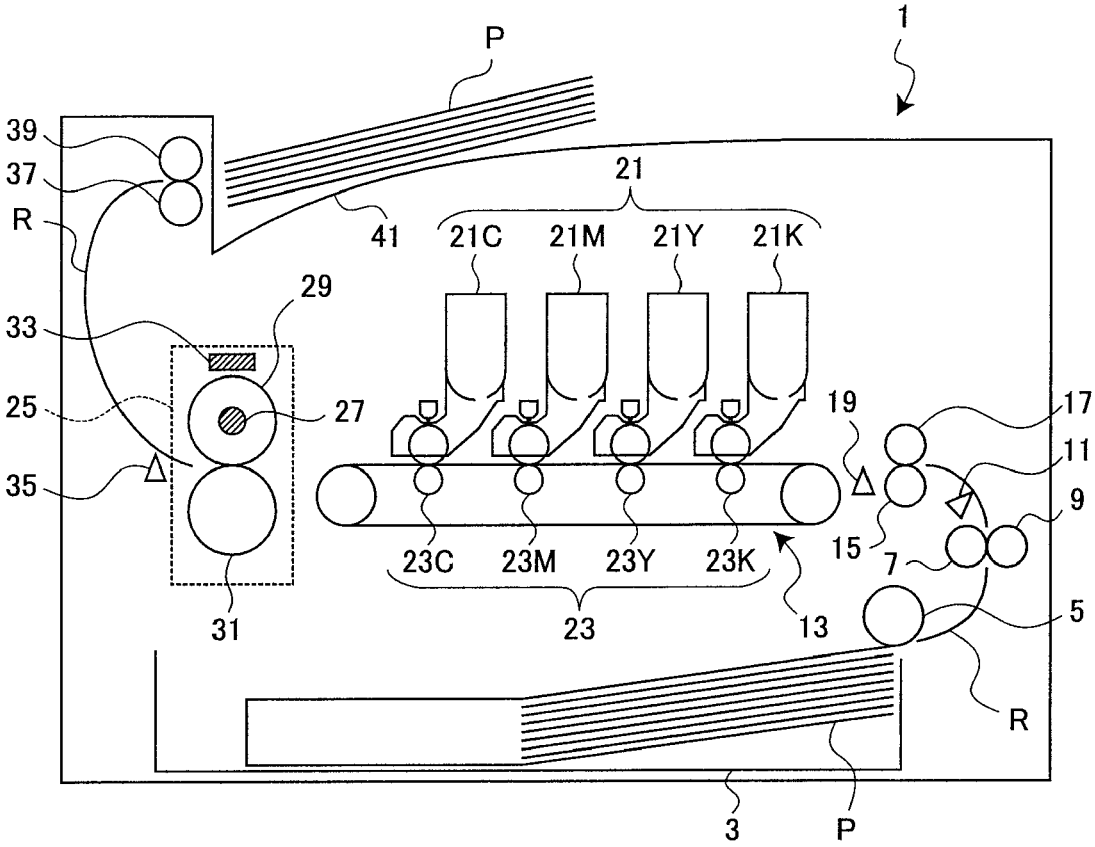
FIG. 1 is a cross sectional view of an image forming apparatus according to the first embodiment.

As shown in FIG. 1, a printer 1 of the first embodiment has a feeding roller 5 feeding paper P stacked on a medium stacker 3 in a direction of medium conveyance route R, a lower resist roller 7 and a pressure roller 9 further conveying the paper P fed by the feeding roller 5 to downstream of the medium conveyance route R, and a first paper sensor 11 detecting the paper P passing the lower resist roller 7 and the pressure roller 9.

The printer 1 drives the feeding roller 5 to feed the paper P stacked on the medium stacker 3 in a downstream direction of the medium conveyance route R. The printer 1 drives the lower resist roller 7 and the pressure roller 9 to further convey the paper P in the downstream direction. The first paper sensor 11 detects the top edge and the bottom edge of the conveyed paper P, and supplies a detected result to a control unit hereinafter described.

The printer 1 further has an upper resist roller 15 and a pressure roller 17 formed downstream of the first paper sensor 11 for conveying the paper P having passed the first paper sensor 11 in a direction of a conveyance belt unit 13, a second paper sensor 19 formed between the upper resist roller 15/the pressure roller 17 and the conveyance belt unit 13 for detecting the passing paper P, a developing unit 21 forming a developer image based on image information input from a host apparatus, and a transfer unit 23 transferring the developer image onto the paper P.

A conveyance belt unit 13 conveys the paper P in the downstream direction of the medium conveyance route R with the use of driving force provided by a drive motor hereinafter described. The transfer belt unit 13 attracts and holds the paper P with electrostatic force, and conveys the paper P to allow the developer image transferred onto the paper P.

The developing unit 21 has a developing unit 21C forming the developer image in cyan, a developing unit 21M forming the developer image in magenta, a developing unit 21Y forming the developer image in yellow, and a developing unit 21K forming the developer image in black. Each of the developing units 21C, 21M, 21Y, and 21K forms the developer image in respective color based on the input image information.

The transfer unit 23 has a transfer roller 23C, a transfer roller 23M, a transfer roller 23Y, and a transfer roller 23K respectively corresponding to developing units 21C, 21M, 21Y, and 21K. The transfer unit 23 transfers onto the paper P the developer image formed by the developing units 21C, 21M, 21Y, and 21K.

The conveyance belt unit 13 conveys the paper P having the developer image transferred thereon by the transfer unit 23 to a fusing device 25 on downstream of the medium conveyance route R.

The fusing device 25 as a fusing unit fuses the developer image transferred and attached to the paper P using heat. The fusing device 25 has a fusing roller 29 having a heater 27 as a heat source therein, a pressure roller 31 in pressurized contact with the developing roller 29, and a temperature detection element 33 as a fusing temperature detection unit detecting the surface temperature of the fusing roller 29.

The heater 27 consists of a heat source such as a halogen lamp and the like, and is driven under the control of the control unit hereinafter described. The heater 27 is arranged in the fusing device 25, and the radiant heat generated by energizing the heater 27 is applied to the fusing roller 29.

The fusing roller 29 fuses the developer attached to the paper P with the surface of the roller heated by the radiant heat applied by the heater 27. The fusing roller 29 is driven under the control of the control unit hereinafter described.

The pressure roller 31 conveys the paper P by sandwiching the paper P with the fusing roller 29, thereby fusing and fixing the developer image attached to the paper P with the use of pressure between the pressure roller 31 and the fusing roller 29.

The temperature detection element 33 detects the surface temperature of the fusing roller 29 heated by the heater 27. The surface temperature of the fusing roller 29 detected by the temperature detection element 33 is supplied to the control unit hereinafter described. The temperature detection element 33 is, for example, a non-contact temperature detection element arranged near the fusing roller 29.

Figure 2:
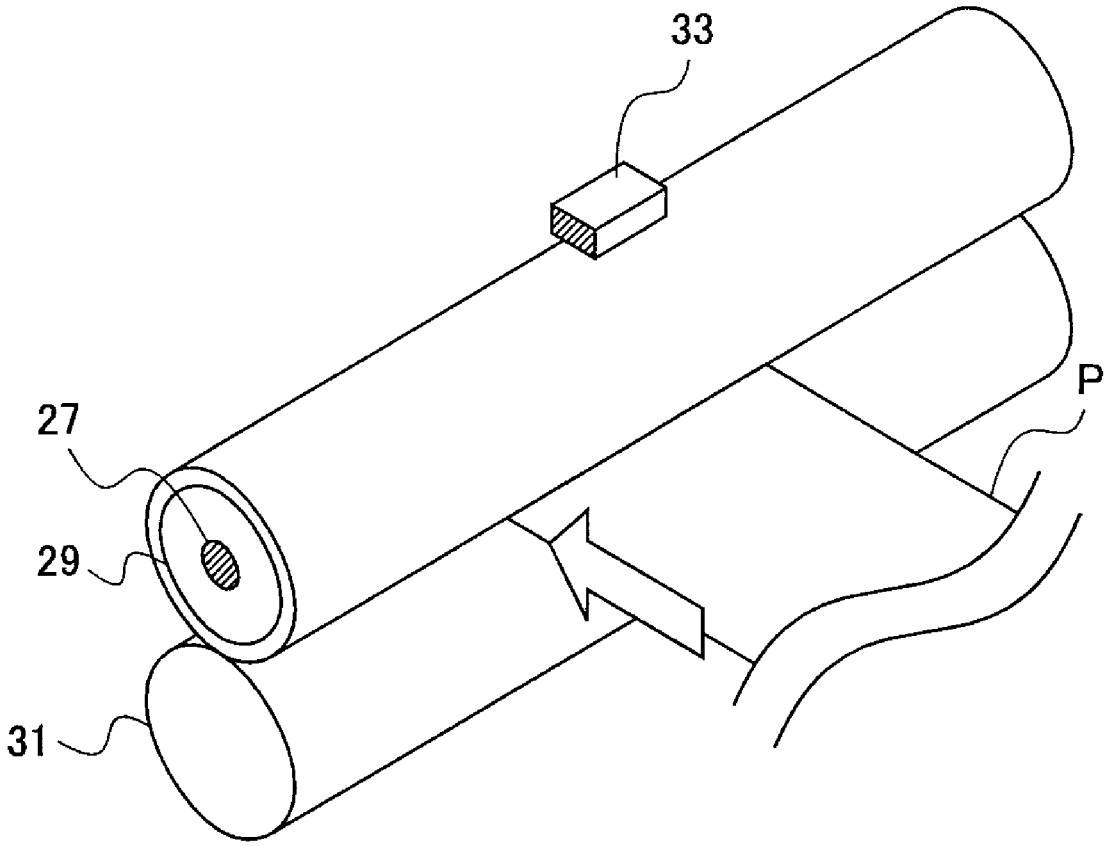
FIG. 2 is a perspective view of an essential portion of a fusing device of the image forming apparatus.
Figure 3:
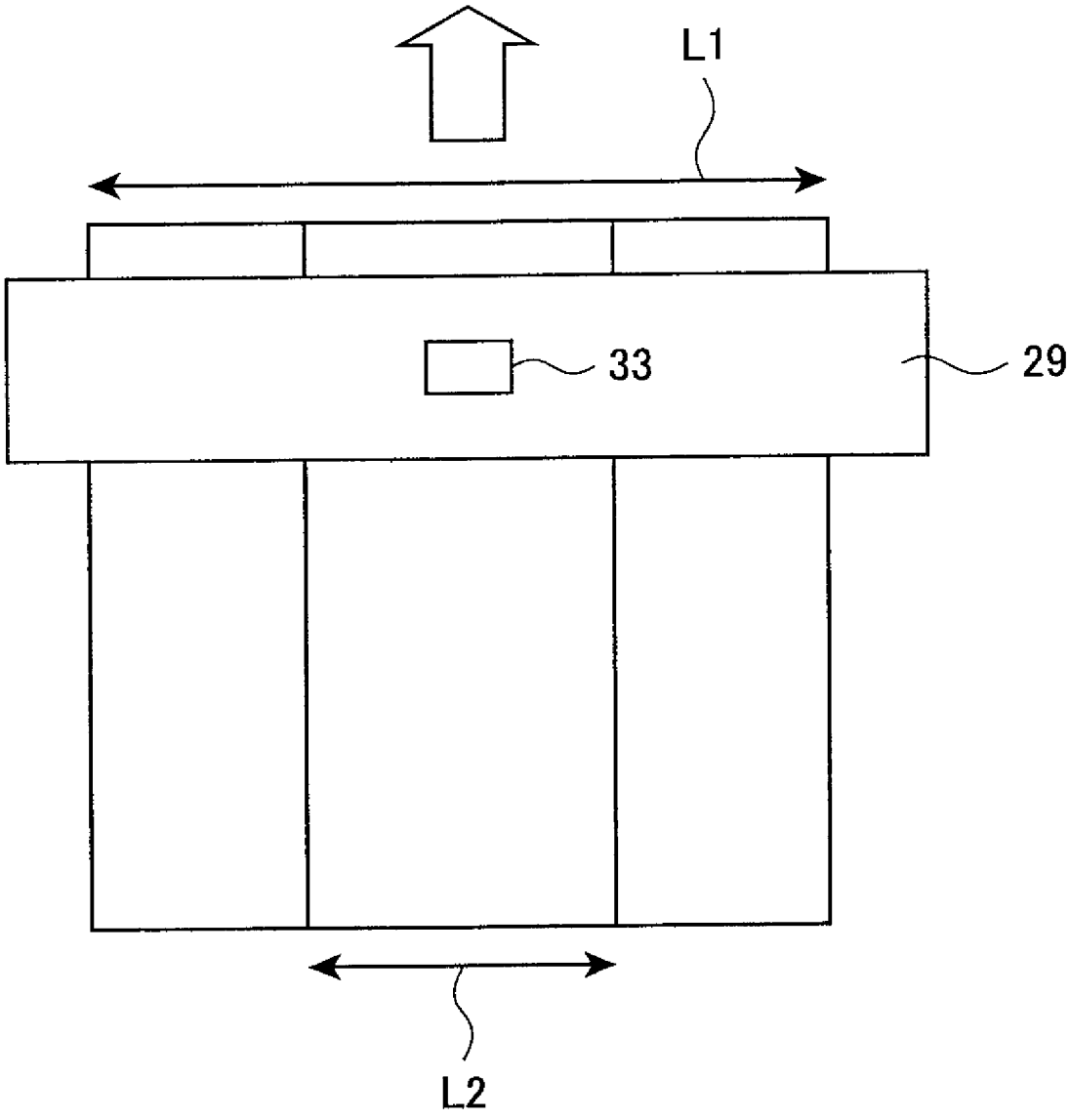
FIG. 3 is a top view of the fusing device.

The axes of the fusing roller 29 and the pressure roller 31 are formed substantially parallel to each other as shown in FIG. 2 The fusing roller 29 and the pressure roller 31 sandwich the paper P with a nip portion thereof, and convey the paper P in the downstream direction of the medium conveyance route R. The temperature detection element 33 is arranged near the center of a maximum paper width L1 and a minimum paper width L2 as shown in FIG. 3.

The structure of the fusing unit is not limited to the fusing device as described above. For example, both the fusing roller 29 and the pressure roller 31 may have heaters therein, and an endless fusing belt can be employed as the fusing roller 29.

The paper P having the developer image thereon fused by the fusing device 25 passes a third paper sensor 35, and is delivered to a discharge stacker 41 by a delivery roller 37 and a pressure roller 39.

Figure 4:
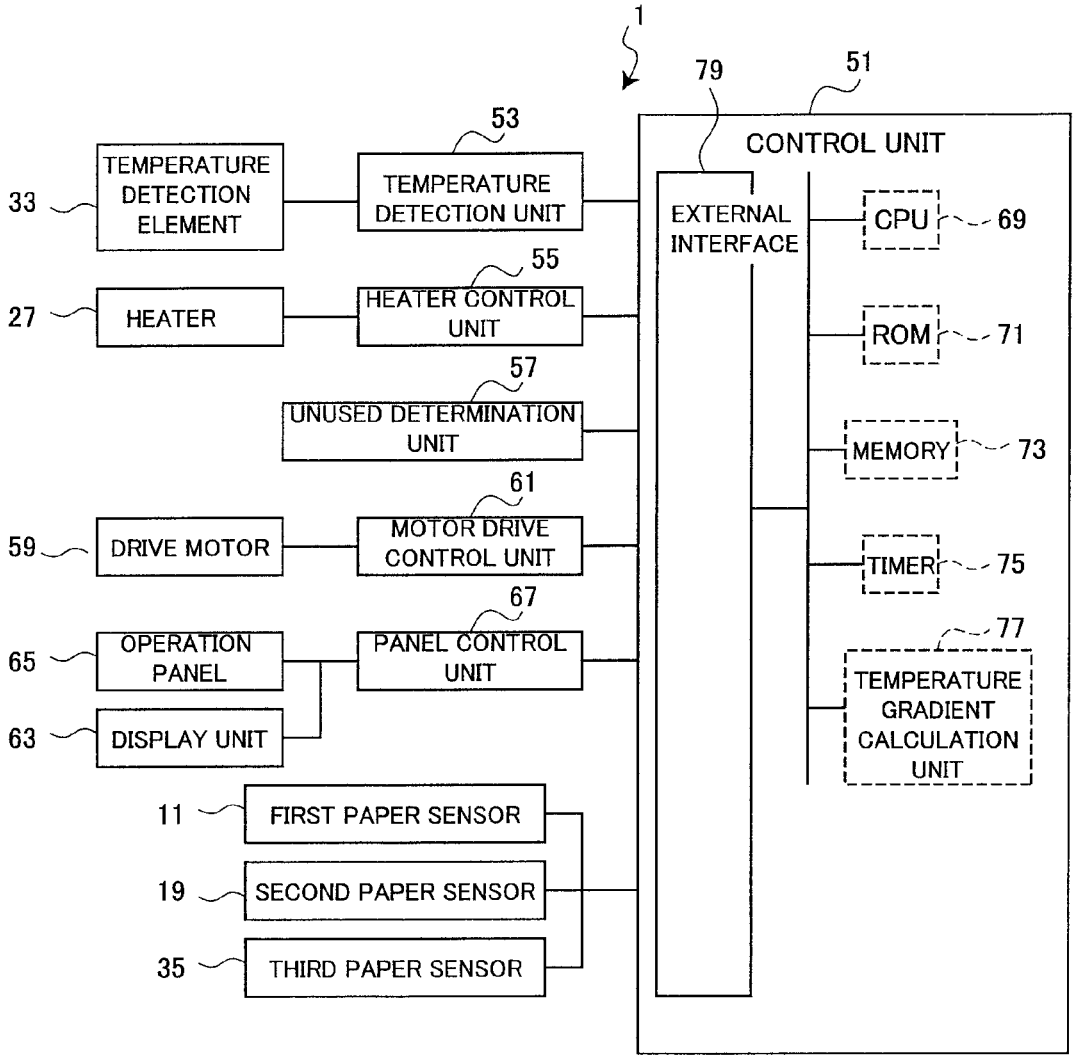
FIG. 4 is a block diagram of the image forming apparatus.

A control system of the printer 1 is hereinafter described with reference to FIG. 4.

The printer 1 has a control unit 51 controlling various units, a temperature detection unit 53 supplying the surface temperature of the fusing roller 29 detected by the temperature detection element 33 to the control unit 51, a heater control unit 55 controlling operation of the heater 27 based on an instruction of the control unit 51, an unused determination unit 57 determining whether the fusing roller 29 is unused after the fusing roller 29 is replaced, a drive motor 59 supplying driving force to various units, a motor drive control unit 61 controlling driving of the drive motor 59, a display unit 63 displaying various information to a user, an operation panel 65 with which the user inputs various information, and a panel control unit 67 controlling the display unit 63 and the operation panel 65.

The control unit 51 has a CPU (Central Processing Unit) 69 executing various processing, a non-volatile rewritable ROM (Read Only Memory) 71 such as EEPROM (Electrically Erasable Programmable Read-Only Memory) memorizing various information, a volatile memory 73, a timer 75 as a time measuring unit, and a temperature gradient calculation unit 77. The control unit 51 has an external interface 79 for inputting information from the outside to those various units and outputting information from those various units to the outside.

When the printer 1 performs printing operation, the CPU 69 executes programs stored in the ROM 71, performs processing of image information transmitted from a host apparatus, and performs control of various units in the printer 1.

Figure 5:
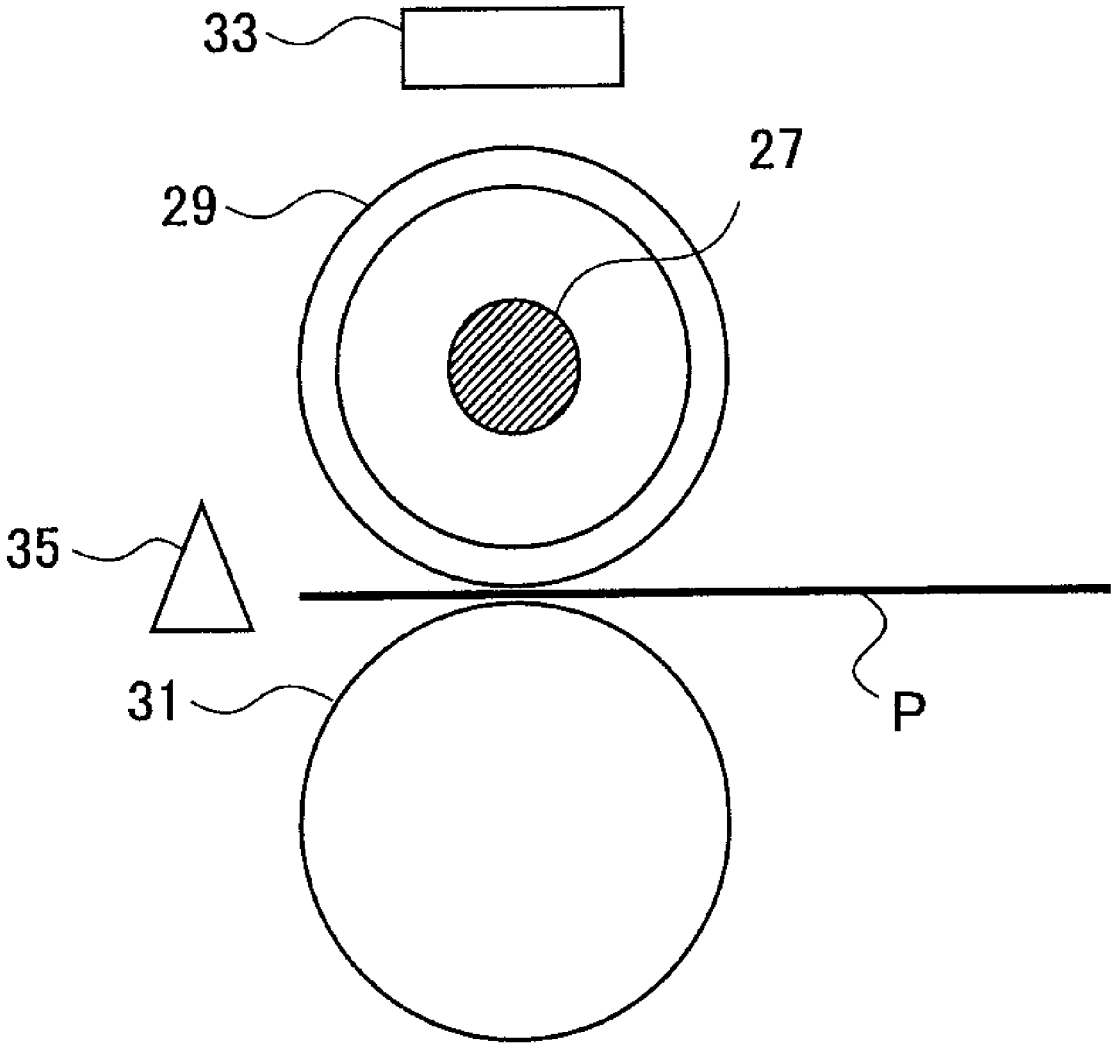
FIG. 5 is a cross sectional view of an essential portion of the fusing device.
Figure 6:
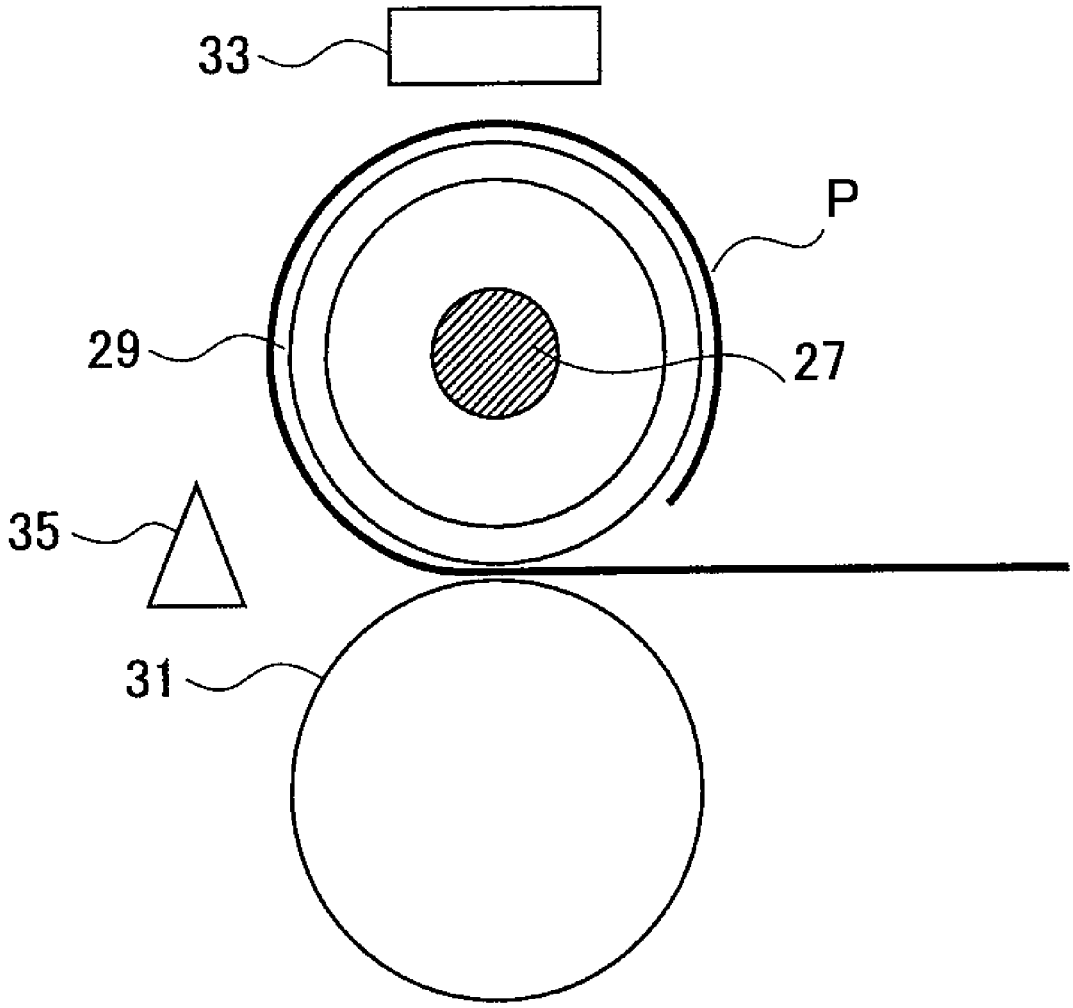
FIG. 6 is a cross sectional view of the essential portion of the fusing device.
Figure 7:
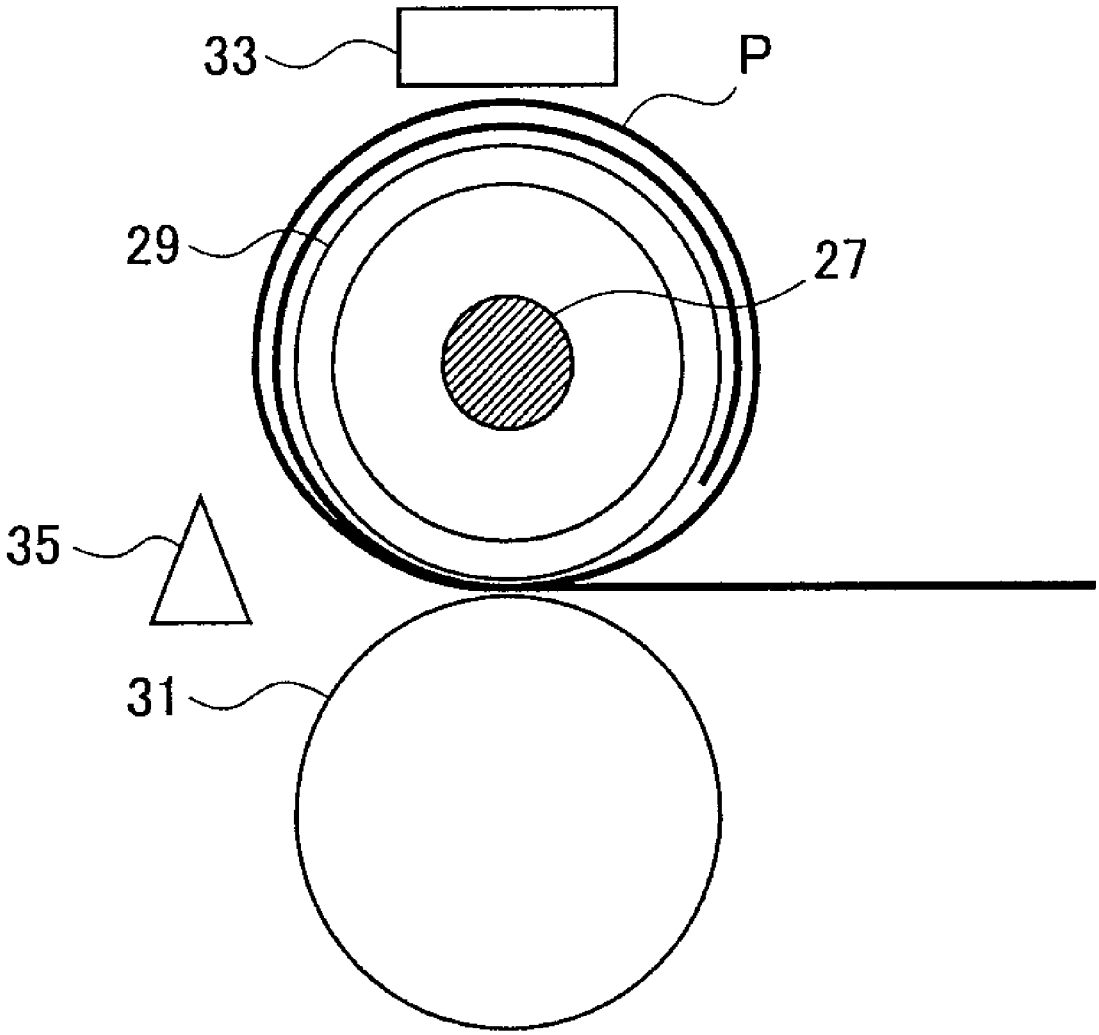
FIG. 7 is a cross sectional view of the essential portion of the fusing device.

The CPU 69 determines whether the paper P remains in the fusing device 25 based on a temperature gradient calculated by the temperature gradient calculation unit 77 and a time duration of the temperature gradient measured by the timer 75. Normally, when the paper P passes the inside of the fusing device 25, the paper P is conveyed in the downstream direction of the medium conveyance route R, and is detected by the third paper sensor 35, as shown in FIG. 5. However, there may a case where the paper P wraps around the fusing roller 29 as shown in FIG. 6 due to some causes. On the other hand, where a sheet of the paper P is jammed near the fusing device 25 in the printer 1, the user removes the jammed sheet of the paper P, and subsequently, the printer 1 conveys and discharges other sheets of the paper P remaining in the medium conveyance route R in the downstream direction of the medium conveyance route R. At this moment, there may be a case where a sheet of the paper P being discharged may wrap around the fusing roller 29, but the printer 1 cannot determine such jamming of the paper P based on a detection result of the paper sensor 35 during the discharge operation of the remaining sheets of the paper P after the user removes the jammed sheet because of a reason hereinafter described, and thus, the printer 1 may cause the paper P to wrap overlappingly around the fusing roller 29 as shown in FIG. 7. As described above, there are two cases in which the paper P is jammed and remains in the printer, and the printer 1 of the present invention can accurately detect the remaining paper P in these different cases. It should be noted that in this specification, a case in which the paper P remains in the printer due to the jamming during the fusing operation as shown in FIG. 6 is simply referred to as "wrapping", and a case where the paper P remains in the printer due to the jamming during the paper discharge operation and the like as shown in FIG. 7 is referred to as "overlapping wrapping."

Wrapping and overlapping wrapping are different from each other with respect to below points. Overlapping wrapping occurs with sheets other than a jammed sheet after occurrence of jamming. This is because after a sheet is jammed and the user removes the jammed sheet, the printer 1 cannot clearly identify the locations of sheets other than the jammed sheet when discharging the sheets. In contrast, if a sheet is jammed during normal printing operation, the printer knows the locations of the paper P based on the detection results of respective paper sensors and the paper conveyance speed, and can thus determine occurrence of jamming where the paper does not pass a paper sensor within a certain period of time. Thus, during normal printing operation, the printer 1 can immediately determine occurrence of jamming to halt the driving of the fusing roller 29, so that overlapping wrapping does not occur. However, in the discharge operation subsequent to an occurrence of jamming, the printer 1 cannot determine the occurrence of jamming based on the detection results of the paper sensors, and thus, the printer 1 cannot halt the driving of the fusing roller 29 even where the paper P wraps around the fusing roller 29 to cause the paper P to overlappingly wrap around the fusing roller 29.

The CPU 69 determines the locations of the paper P on the medium conveyance route R by looking up the detection results of the first paper sensor 11, the second paper sensor 19, and the third paper sensor 35.

The timer 75 measures time duration when the printer 1 performs printing operation and the like.

The temperature gradient calculation unit 77 calculates the temperature gradient of declining temperature of the fusing roller 29 based on information about the surface temperature of the fusing roller 29 supplied by the temperature detection unit 53. Specifically, the temperature gradient calculation unit 77 continuously memorizes in the memory 73 information about the temperature supplied by the temperature detection unit 53 and the time duration measured by the timer 75, and calculates the temperature gradient using this information about the temperature and the time duration. The temperature gradient calculated by the temperature gradient calculation unit 77 is memorized, for example, in the memory 73, and read out by the CPU 69.

The temperature detection unit 53 supplies the detection result of the surface temperature of the fusing roller 29 detected by the temperature detection element 33 to the control unit 51. The detection result of the surface temperature of the fusing roller 29 supplied to the control unit 51 by the temperature detection unit 53 is used by the temperature gradient calculation unit 77 to calculate the temperature gradient. The detection result of the surface temperature of the fusing roller 29 supplied to the control unit 51 by the temperature detection unit 53 is also used by the CPU 69 to manage operation of the heater 27.

The heater control unit 55 controls operation of the heater 27 under the control of the control unit 51. For example, where at start-up of the printer 1, the CPU 69 supplies to the heater control unit 55 an instruction to energize the heater 27 to heat the fusing roller 29 to a temperature at which the developer image can be fused, the heater control unit 55 heats the fusing roller 29 to the temperature at which the developer image can be fused. On the other hand, for example, where the CPU 69 recognizes that the surface of the fusing roller 29 reaches the temperature at which the developer image can be fused or where the printer 1 performs shut-down operation, the heater control unit 55 de-energize the heater 27 to halt the heating of the fusing roller 29. The CPU 69 looks up the detection result of the temperature detection element 33 and supplies a prescribed instruction to the heater control unit 55, and thus, the heater control unit 55 manages operation of the heater 27 as described above.

When the printer 1 performs printing, the motor drive control unit 61 controls the driving of the drive motor 59 according to an instruction from the control unit 51. The driving force of the drive motor 59 is supplied to the paper feed roller 5, the lower resist roller 7, and the like.

The display unit 63 displays various information to the user, for example, on an LCD (Liquid Crystal Display). The user inputs various instructions with the operation panel 65 arranged with the display unit 63.

The panel control unit 67 controls the display unit 63 to display information thereon under the control of the control unit 51. The panel control unit 67 also supplies information input by the user with the operation panel 65 to the control unit 51.

Figure 8:
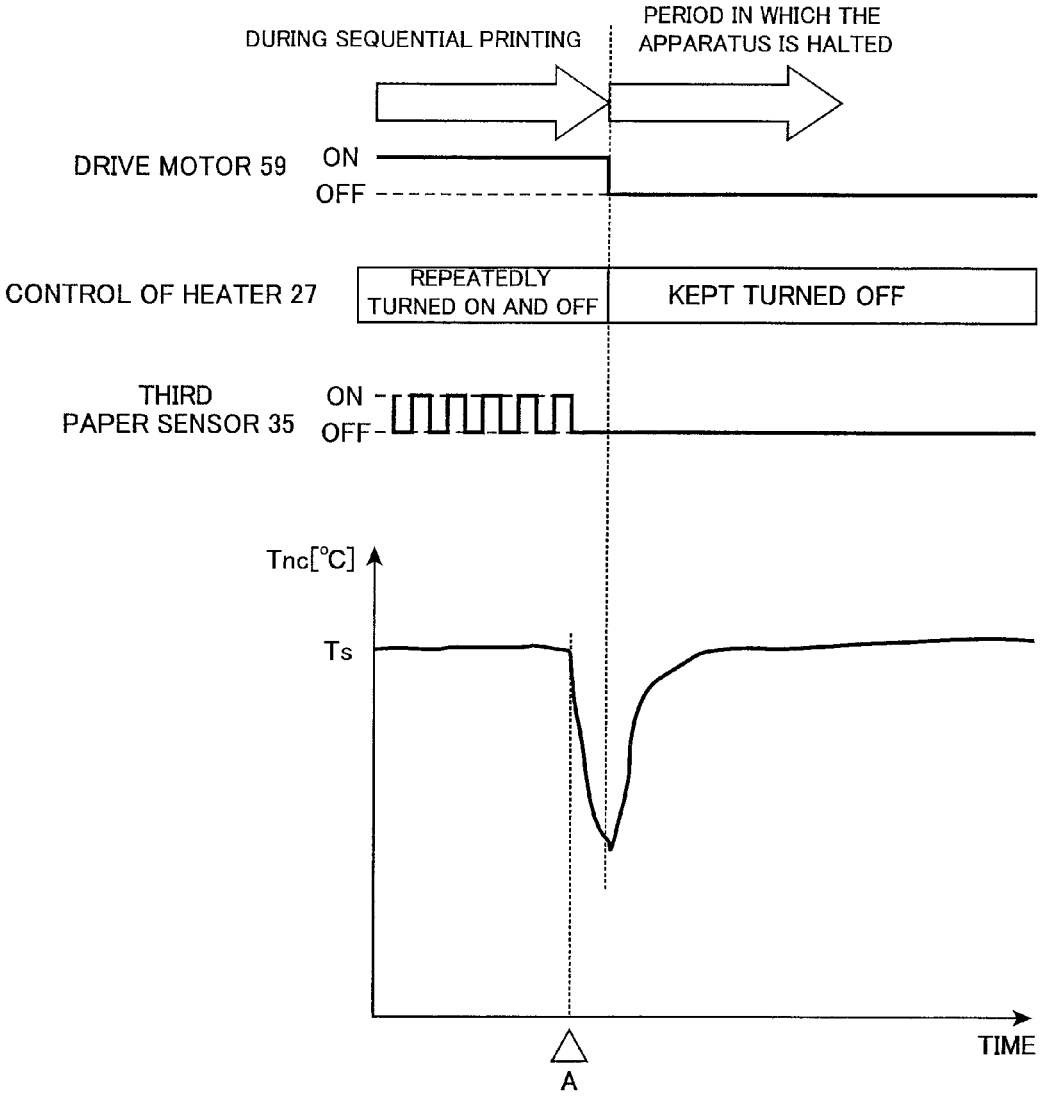
FIG. 8 is a time chart illustrating operation of the image forming apparatus.

As shown in FIG. 8, for example during successive printing, the printer 1 energizes the drive motor 59 to convey the paper P along the medium conveyance route R, and maintains the detected surface temperature Tnc of the fusing roller 29 to the fusing temperature Ts by repeatedly energizing and de-energizing the heater 27. At this moment, the third paper sensor 35 on the downstream of the fusing device 25 detects the paper P passing the third paper sensor 35, and turns on a signal if detecting the paper P and turns off the signal unless detecting the paper P. Suppose that a sheet of the paper P wraps around the fusing roller 29 at time A due to some causes, the third paper sensor 35 turns off the signal because the sheet wrapping around the fusing roller 29 does not pass the third paper sensor 35, and the detected surface temperature Tnc rapidly drops, namely, a temperature drop occurs. This is because the sheet of the paper P wrapping around the fusing roller 29 resides between the fusing roller 29 and the temperature detection element 33 to disable the temperature detection element 33 from detecting the surface temperature of the fusing roller 29. Then, the printer 1 halts the motor 59 based on the detection result of the third paper sensor 35. At this moment, the printer 1 de-energizes the heater 27 to halt the heating of the fusing roller 29. Upon the halt of the drive motor 59, the detected surface temperature Tnc increases because heat stored in the fusing roller 29 is released.

Figure 9:
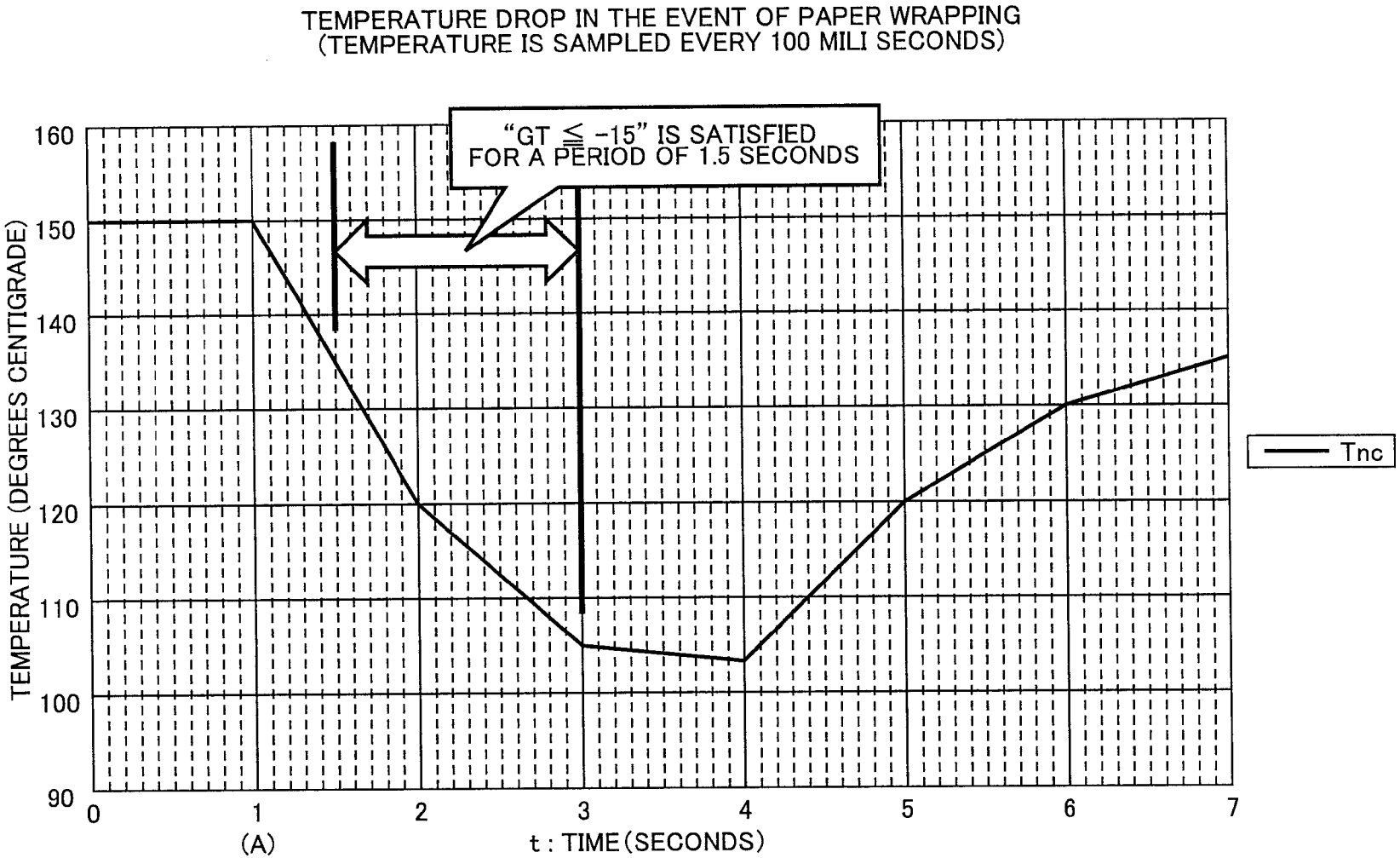
FIG. 9 is a profile of the surface temperature of a fusing roller inside the fusing device.

As described above, the temperature gradient calculation unit 77 calculates the temperature gradient of decreasing temperature of the fusing roller 29. FIG. 9 is a chart made by plotting surface temperatures of the fusing roller when the sheet thus wraps around the fusing roller. The detected surface temperature Tnc of the fusing roller 29 is sampled and plotted on the chart every 100 ms as shown in FIG. 9. For example, suppose that the fusing temperature Ts is 150 degrees Celsius, the temperature drop occurs at time A, and the detected temperature Tnc becomes the lowest three seconds after time A. Where the temperature gradient GT is defined as:

$$GT=dTnc/dt(\text{degrees Celsius/second}),$$

the below inequation is satisfied for a period of 1.5 seconds:

GT is smaller than or equal to −15(degrees Celsius/second).

Figure 10:
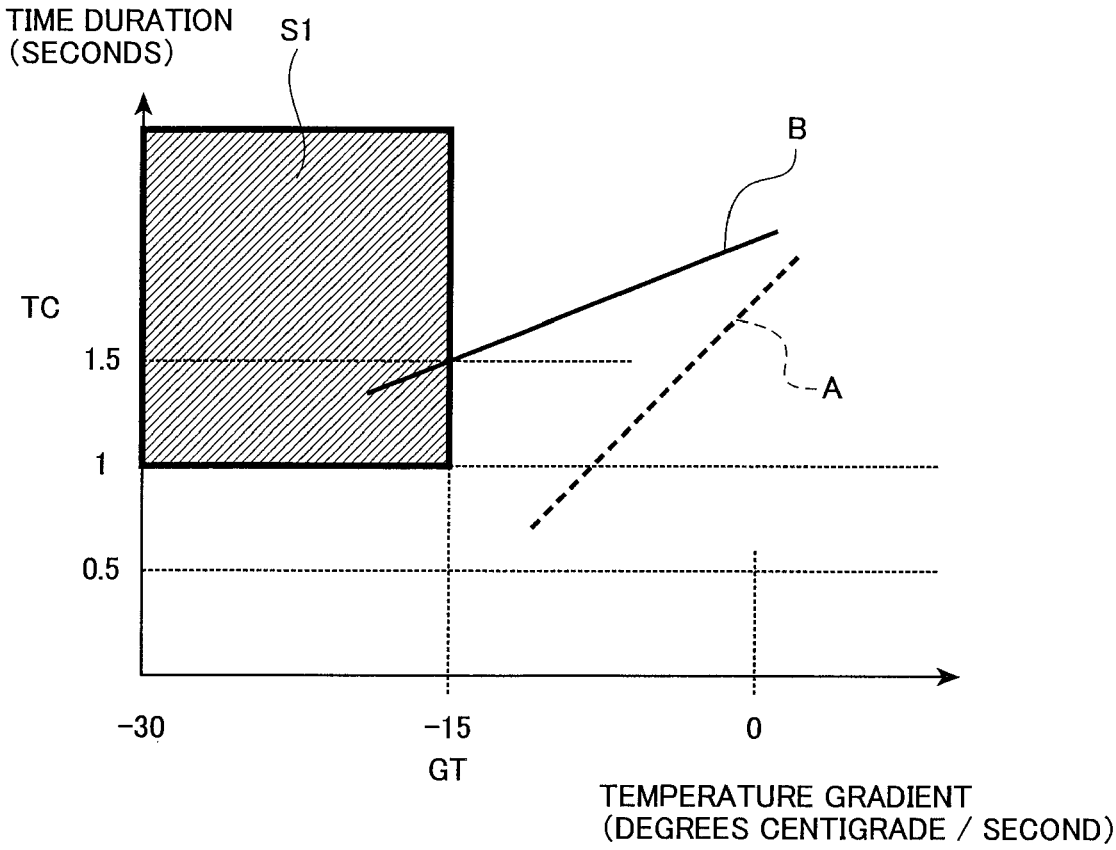
FIG. 10 is a chart showing relationship between the temperature gradient of the surface temperature of the fusing roller and the time duration.

FIG. 10 is a chart showing the relationship between the temperature gradient GT and the time duration TC for which the detected surface temperature Tnc continues to increase or decrease at the temperature gradient GT. Where the paper P does not remain in the fusing device 25, i.e., during normal fusing operation, the relationship between the temperature gradient GT and the time duration TC is represented by line A. Where the sheet wraps around the fusing roller, the relationship between the temperature gradient GT and the time duration TC is represented by line B. As is evident from the chart, where the sheet wraps around the fusing roller, the temperature gradient GT becomes smaller (i.e., larger in absolute value) and the time duration becomes longer than in normal fusing operation. A wrapping temperature gradient reference value (a first temperature gradient reference value) and a wrapping time duration reference value (a first time duration reference value) are previously calculated through experiment and are stored in the printer 1, for example, in the ROM 71 therein. The CPU 69 looks up the wrapping temperature gradient reference value and the wrapping time duration reference value, and determines the occurrence of wrapping where the temperature gradient GT is smaller and the time duration TC is longer than corresponding values during normal fusing operation.

Specifically, a wrapping occurring threshold area S1 with which line A does not overlap is previously defined in the chart showing the relationship between the temperature gradient GT and the time duration TC, and the printer 1 determines the occurrence of wrapping where line B overlaps with the threshold area S1. In a case of the above example, the printer 1 sets the wrapping temperature gradient reference value to −15 degrees Celsius/second and sets the wrapping time duration reference value to 1 second, and the printer 1 determines the occurrence of wrapping where the temperature gradient is less than or equal to the wrapping temperature gradient reference value and the time duration is longer than or equal to the wrapping time duration reference value.

Thus, the printer 1 can detect the remaining paper P without being influenced by an instantaneous spike noise in the temperature gradient by determining whether the paper P remains in the fusing device 25 based on the temperature gradient GT and the time duration TC.

In addition to the above-mentioned wrapping temperature gradient reference value and the wrapping time duration reference value, the ROM 71 also memorizes an overlapping wrapping temperature gradient reference value (a second temperature gradient reference value) and an overlapping wrapping time duration reference value (a second time duration reference value).

Figure 11:
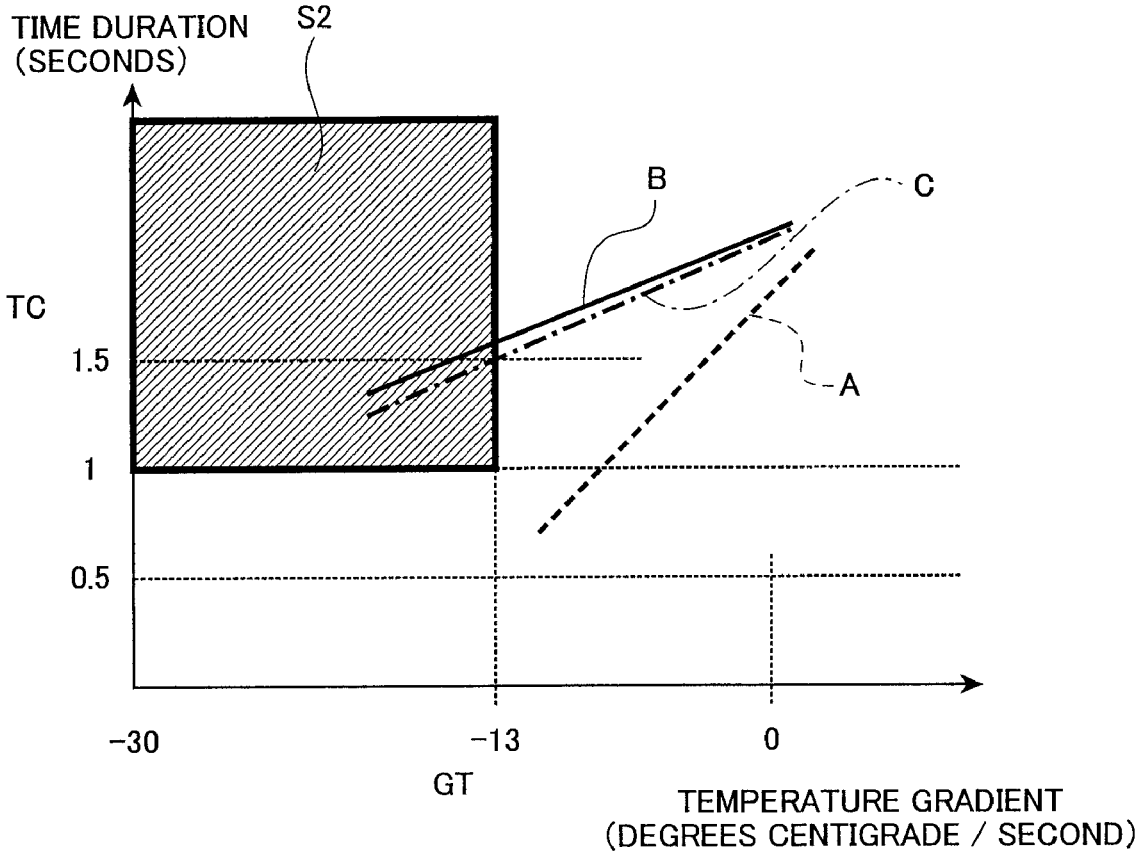
FIG. 11 is a chart showing relationship between the temperature gradient of the surface temperature of the fusing roller and the time duration.

FIG. 11 is a chart showing a case where a sheet overlappingly wraps around the fusing roller. The detected surface temperature Tnc is sampled in a way similar to the above, and the relationship between the temperature gradient value GT and the time duration TC is plotted as line C in FIG. 11. Line A and line C show that where a sheet overlappingly wraps around the fusing roller, the temperature gradient GT becomes smaller (i.e., larger in absolute value) and the time duration TC becomes longer than in normal fusing operation. Considering the above, the printer 1 sets the overlapping wrapping temperature gradient reference value to −13 degrees Celsius/second and sets the overlapping wrapping time duration reference value to 1 second, and the printer 1 determines the occurrence of overlapping wrapping where the temperature gradient is less than or equal to the overlapping wrapping temperature gradient reference value and the time duration is longer than or equal to the overlapping wrapping time duration reference value.

Therefore, the overlapping wrapping temperature gradient reference value for overlapping wrapping should be set to more (i.e., less in absolute value) than the wrapping temperature gradient reference value for wrapping. For example, suppose that when the front edge of a sheet of the paper P is located at the nip portion between the fusing roller 29 and the pressure roller 31, another sheet is jammed somewhere else in the printer 1. In such situation, the front edge of the sheet at the nip portion is heated by heat from the fusing roller 29. Then, the user removes the jammed sheet from the printer 1 and have the printer 1 perform the discharge operation, and if the heated sheet located at the nip portion wraps around the fusing roller during this discharge operation, the temperature gradient GT of the fusing roller 29 becomes more (i.e., less in absolute value) than the temperature gradient GT at the time when a sheet wraps around the fusing roller during normal fusing operation. Considering such occurrence of the overlapping wrapping, the overlapping wrapping temperature gradient reference value is preferred to be set to more than the wrapping temperature gradient reference value for the wrapping. In the embodiment of this invention, the wrapping temperature gradient reference value is set to −15 degrees Celsius/second, the wrapping time duration reference value is set to 1 second, the overlapping wrapping temperature gradient reference value is set to −13 degrees Celsius/second, the overlapping wrapping time duration reference value is set to 1 second, and the occurrence of wrapping or overlapping wrapping is determined where the temperature gradient is less than or equal to the corresponding temperature gradient reference value and the time duration is more than or equal to the corresponding time duration reference value. However, these temperature gradient reference value and time duration reference value are determined through experiment, and can be arbitrary changed depending on the fusing temperature and conditions, material and structure of the fusing roller 29 and the pressure roller 31, and the like.

Operation of the printer 1 is hereinafter descried.

Figure 12:
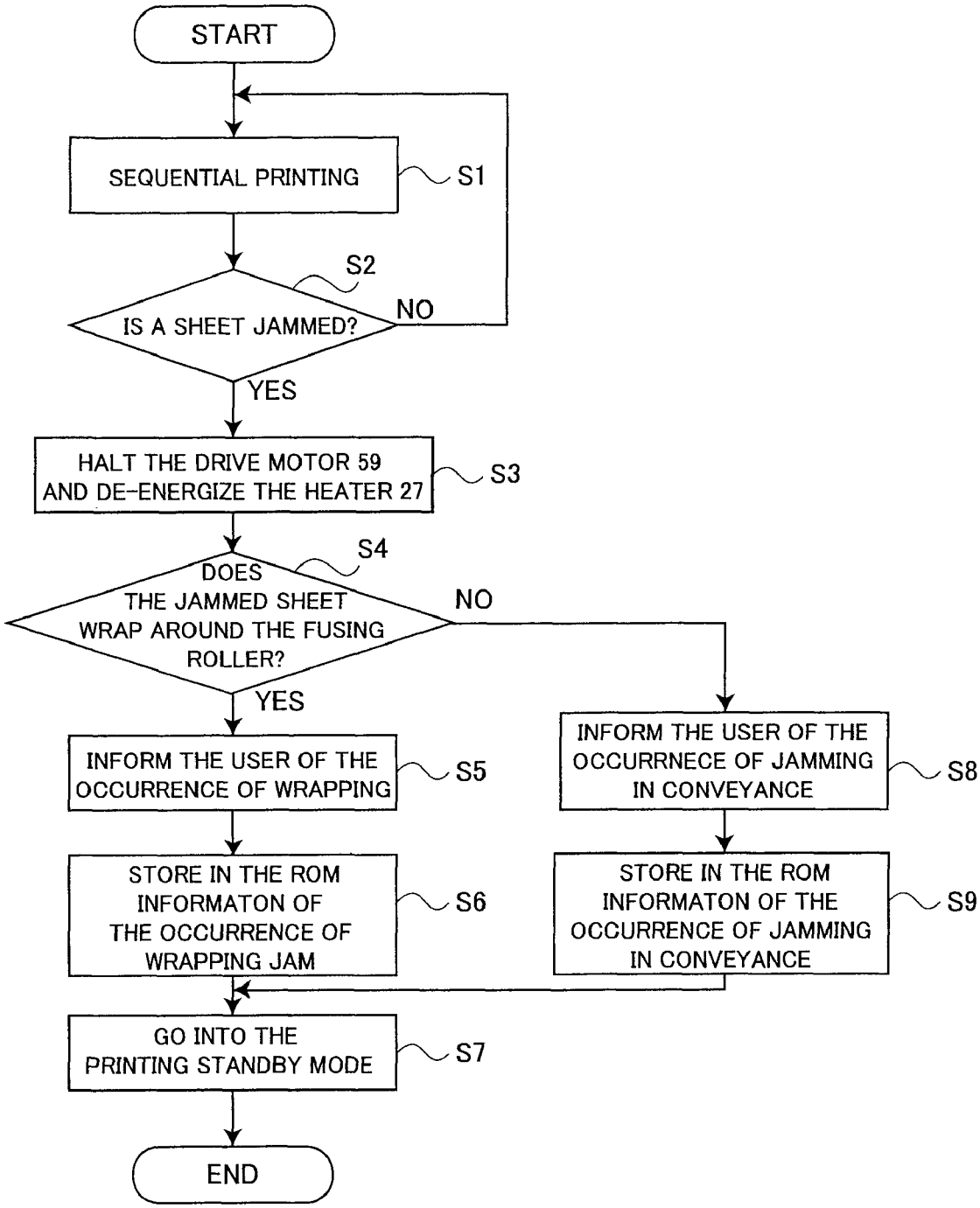
FIG. 12 is a flow chart of operation of the image forming apparatus.

First, operation of the printer 1 is hereinafter described with reference to FIG. 12 where a sheet of paper is jammed near the fusing device 25 during normal printing operation. For convenience sake, operation of the printer 1 is described when the printer 1 successively prints multiple sheets of multiple print jobs.

The printer 1 receives image information from a host apparatus and starts a series of operation, and then, the printer 1 start printing operation at step S1. At this moment, the CPU 69 instructs the motor drive control unit 61 to drive the fusing roller 29, and watches the detection result of the temperature detection element 33 supplied by the temperature detection unit 53 to maintain the surface temperature of the fusing roller 29 to a temperature at which a developer image can be fused. The temperature gradient calculation unit 77 starts operation to store the detection result of the temperature detection element 33 supplied by the temperature detection unit 53 in the memory 73 at a prescribed time interval, and the timer 75 starts measuring time. The printer 1 instructs the motor drive control unit 61 to start driving the drive motor 59, and starts watching locations of the paper P in the medium conveyance route R with the first paper sensor 11, the second paper sensor 19, and the third paper sensor 35.

Then, at step S2, the printer 1 determines whether paper jam occurs. Specifically, the printer 1 determines whether the paper jam occurs between the developing unit 21 and the fusing unit 25 based on the detection result of the third paper sensor 35. Then, where the paper jam does not occur, the printer 1 determines that the paper jam does not occur between the developing unit 21 and the fusing device 25, and executes operation of step S1.

On the other hand where the printer 1 determines that the paper jam occurs, the printer 1 halts driving of the drive motor 59 and de-energizes the heater 27. Specifically, such operation is performed by having the CPU 69 provide the heater control unit 55 with an instruction to de-energize the heater 27 and provide the motor drive control unit 61 to halt the motor 59.

At step S4, the printer 1 determines the occurrence of wrapping by determining whether a line made by plotting the relationship between the temperature gradient GT calculated by the temperature gradient calculation unit 77 and the time duration TC measured by the timer 75 overlaps with the threshold area S1. Where the printer 1 determines that the line does not overlap with the threshold area S1, the printer 1 determines that the wrapping does not occur. Where the printer 1 determines that the line overlaps with the threshold area S1, the printer 1 determines the occurrence of wrapping.

Where the printer 1 determines the occurrence of wrapping, the printer 1 informs the user of the occurrence of wrapping at step S5. That is, the CPU 69 instructs the panel control unit 67 to display information of the occurrence of wrapping on the display unit 63. Thus, the user can recognize the occurrence of wrapping in the fusing device 25, that is, the printer 1 can clearly inform the user of the cause of japer jamming.

Thereafter, the printer 1 stores information of the occurrence of wrapping jam in the ROM 71 at step S6. Then, the printer 1 enters into a standby mode at step S7 to wait until the user removes a jammed sheet, and terminates this flow of steps.

On the other hand, where the printer 1 determines that wrapping does not occur at step S4, the printer 1 informs the user of an occurrence of jamming in conveyance at step S8. That is, where wrapping does not occur, the printer 1 determines the occurrence of jamming due to other reasons. The printer 1 informs the user of such circumstances with the display unit 63 so that the user can easily identify the cause of jamming.

Thereafter, the printer 1 stores the information of the occurrence of jamming in conveyance in the ROM 71 at step S9, executes operation at step S7, and terminates this flow of steps.

Figure 13:
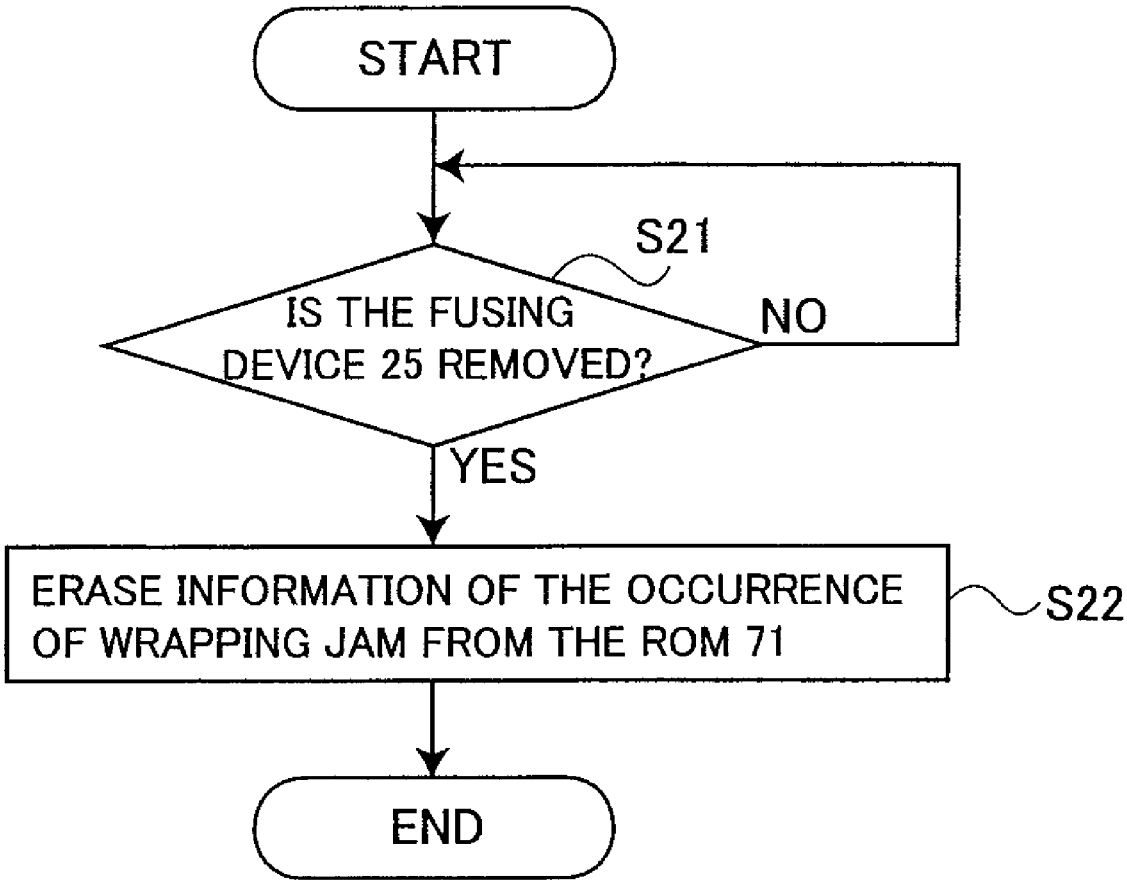
FIG. 13 is a flow chart of operation of the image forming apparatus.

Operation to erase the information of the occurrence of wrapping jam stored in the ROM 71 is hereinafter described with reference to FIG. 13. It is assumed that the printer 1 is kept turned on in the operation described in FIG. 13.

Once this operation is started, the printer 1 determines whether the fusing device 25 is removed at step S21. The printer 1 determines the removal of the fusing device 25 by determining whether the temperature detection unit 53 can detect a signal from the temperature detection element 33. For example, where the user removes the fusing device 25 to remove the wrapped paper, the temperature detection unit 53 cannot receive the signal from the temperature detection element 33. The printer 1 repeats such operation until determining that the fusing device 25 is removed.

The printer 1 erases the information of the occurrence of wrapping jam from the ROM 71 at step S22, and terminates this flow of steps.

Figure 14:
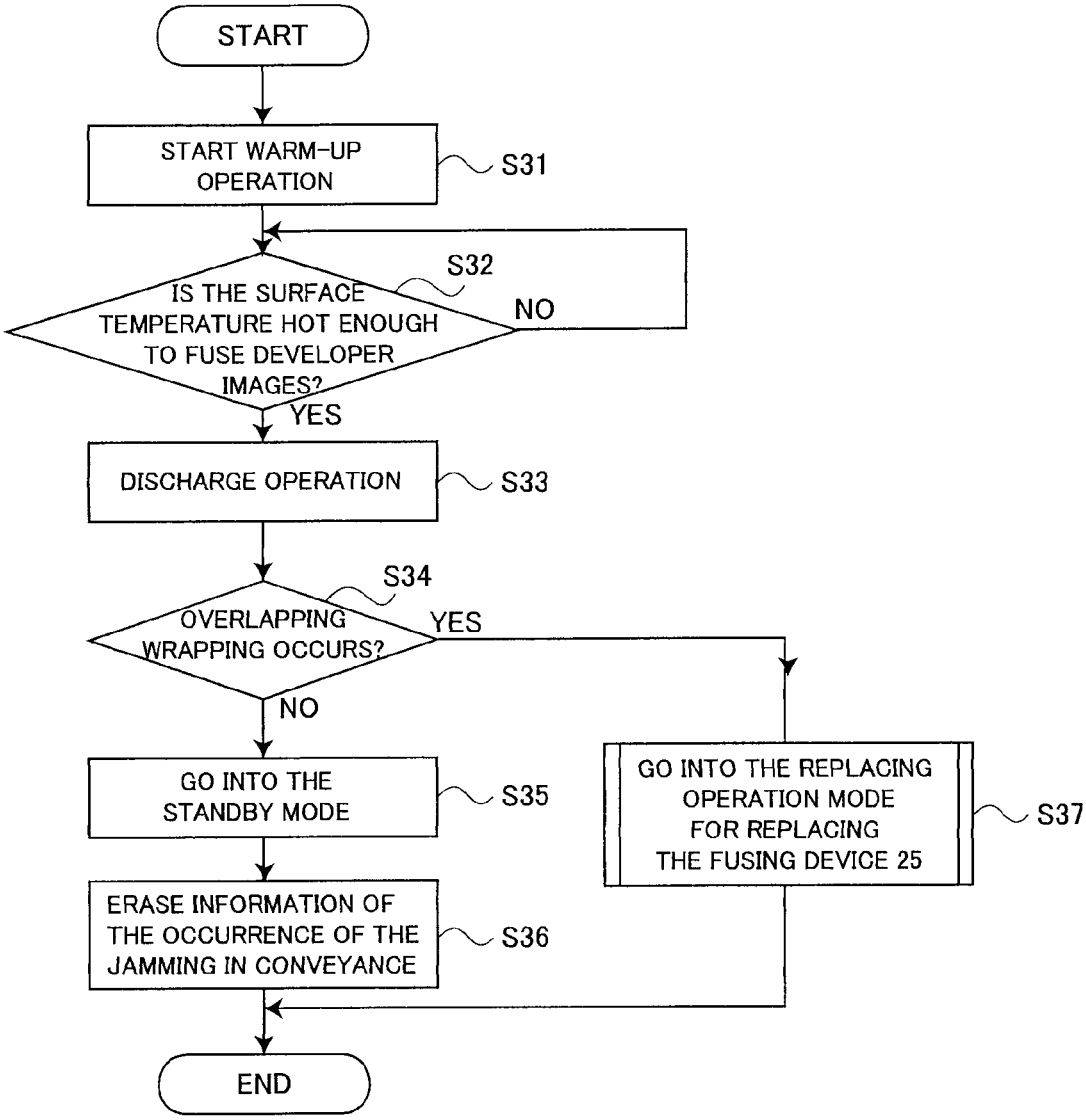
FIG. 14 is a flow chart of operation of the image forming apparatus.

Operation to erase the information of the occurrence of jamming in conveyance stored in the ROM 71 is hereinafter described with reference to FIG. 14. Where erasing the information of the occurrence of jamming in conveyance, there is a possibility that sheets other than a jammed sheet may overlappingly wrap around the fusing roller when the printer 1 discharges the sheets after the user removes the jammed sheet, and thus, the printer 1 watches whether overlapping wrapping occurs during such discharge operation. It is assumed that the printer 1 is kept turned on in the operation described in FIG. 14.

When the user removes a sheet of paper P jammed in conveyance and closes a cover, not shown, the printer 1 detects that the jammed sheet is removed and starts this flow of steps, that is, the printer 1 starts warm-up operation at step S31. For example, the CPU 69 instructs the heater control unit 55 to energize the heater 27 so that the heart 27 starts to heat. At this moment, the printer 1 starts watching and controlling the surface temperature of the fusing roller 29 based on the detection result of the temperature detection unit 53.

Then, at step S32, the printer 1 determines whether the surface temperature of the fusing roller 29 reaches a temperature at which developer images can be fused. The printer 1 repeats such operation until determining that the surface temperature of the fusing roller 29 reaches the temperature at which developer images can be fused.

The printer 1 executes the discharge operation of the paper P at step S33. Specifically, the CPU 69 instructs the motor drive control unit 61 to drive the drive motor 59 to discharge sheets of the paper P other than the jammed sheet. Thus, the sheets of the paper P are discharged from respective locations at the time of the occurrence of jamming to downstream of the medium conveyance route R.

The printer 1 determines the occurrence of overlapping wrapping at step S34. Specifically, the printer 1 determines whether a line made by plotting the relationship between the temperature gradient GT calculated by the temperature gradient calculation unit 77 and the time duration TC measured by the timer 75 overlaps with a threshold area S2. Where the printer 1 determines that the line does not overlap with the threshold area S2, the printer 1 determines that overlapping wrapping does not occur. Where the printer 1 determines that the line overlaps with the threshold area S2, the printer 1 determines the occurrence of overlapping wrapping.

Figure 15:
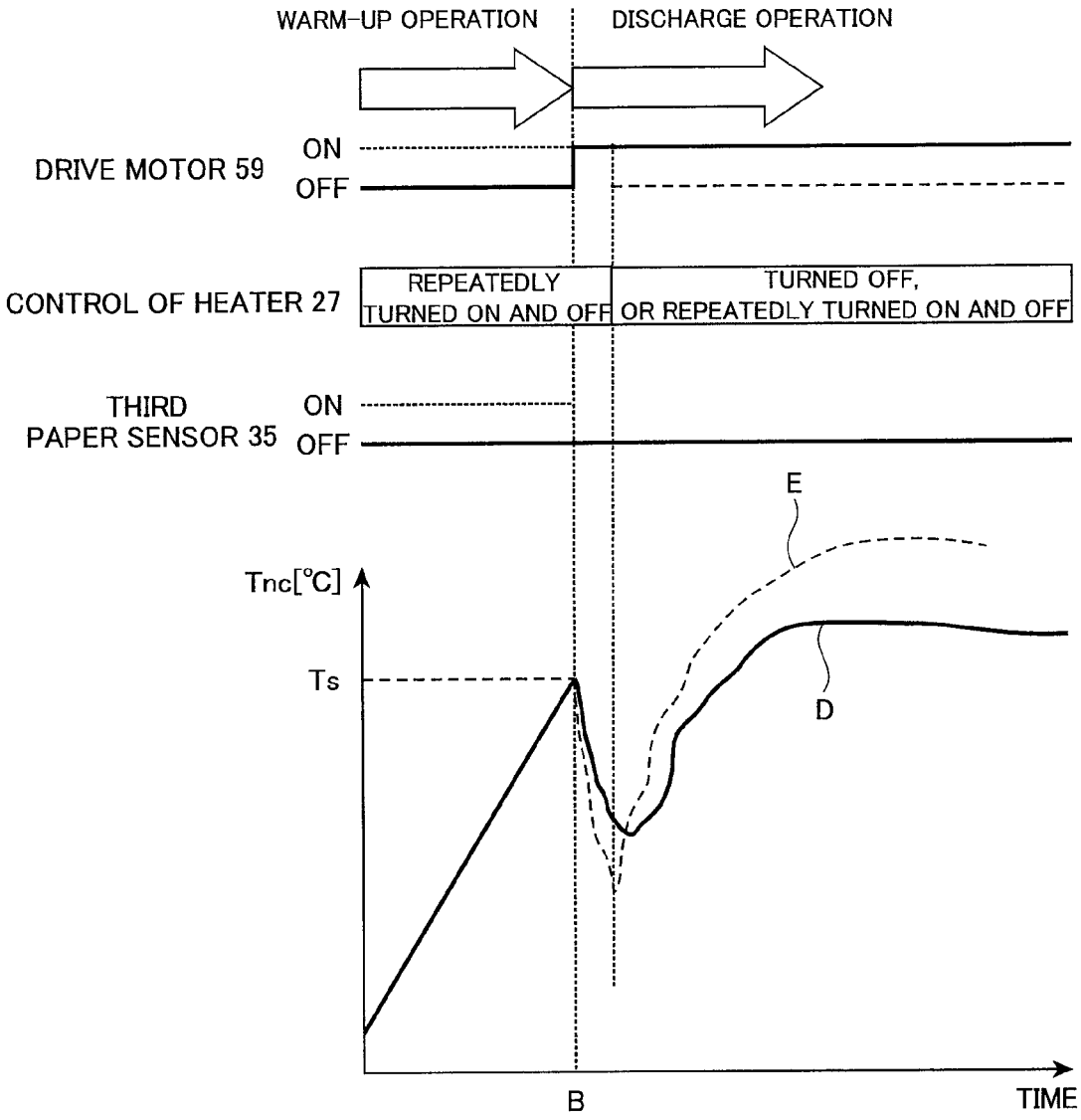
FIG. 15 is a time chart illustrating operation of the image forming apparatus.

For example, where the detected surface temperature Tnc of the fusing roller 29 rapidly drops at time B as shown in FIG. 15, the printer 1 determines the occurrence of overlapping wrapping based on the relationship between the temperature gradient GT and the time duration TC. Where the paper P is conveyed normally without occurrence of overlapping wrapping, the detected surface temperature Tnc of the fusing roller 29 temporarily drops upon contacting with the paper P, however, such temperature drop of the detected surface temperature Tnc is relatively mild as shown by a waveform D because the printer 1 controls and keeps the surface temperature Ts of the fusing roller 29 at the fusing temperature Ts by energizing and de-energizing the heater 27. On the other hand, where the paper P overlappingly wraps around the fusing roller 29, the detected surface temperature Tnc of the fusing roller 29 drops rapidly, and as shown by a waveform E, the temperature gradient during such temperature drop is smaller (i.e., larger in absolute value) than the temperature gradient during normal conveyance of the paper P. The printer 1 of the present invention can determine the occurrence of overlapping wrapping around the fusing roller 29 based on the difference in the change of the detected surface temperature Tnc, namely, the difference of the temperature gradient GT. The reason why the waveform E overshoots is that the printer 1 halts the drive motor 59 and de-energize the heater 27 to allow the heat stored in the fusing roller 29 to be released where the printer 1 determines the occurrence of overlapping wrapping around the fusing roller 29.

Where the printer 1 determines that the overlapping wrapping does not occur, the printer 1 enters into the standby mode at step S35. Thereafter, the printer 1 erases the information of the occurrence of jamming in conveyance from the ROM 71 at step S36, and terminates this flow of steps.

Figure 17:
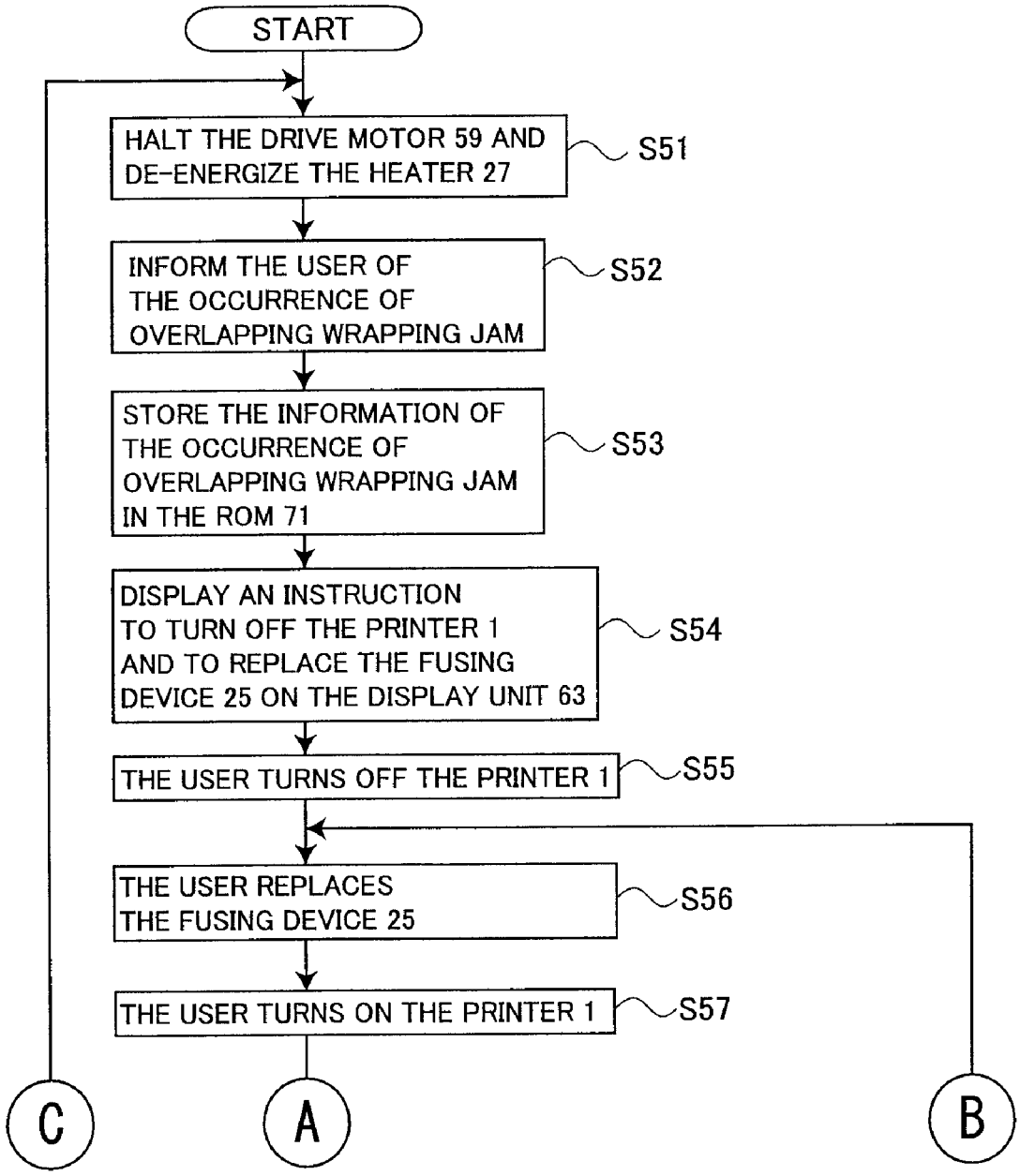
FIG. 17 is a flow chart of operation of the image forming apparatus.
Figure 18:
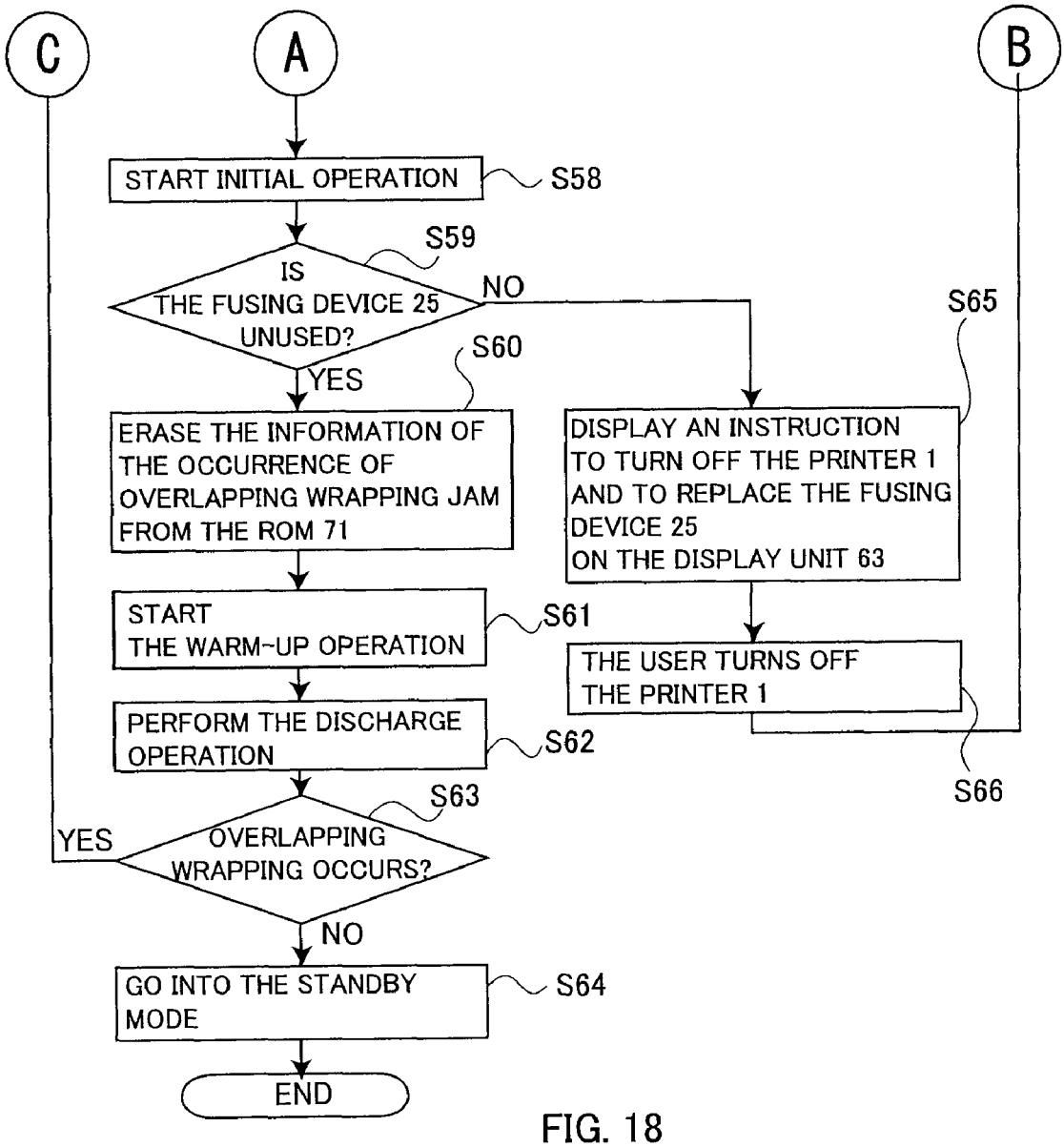
FIG. 18 is a flow chart of operation of the image forming apparatus.

On the other hand, where the printer 1 determines the occurrence of overlapping wrapping at step S34, the printer 1 proceeds to step S37 to go into a replacing operation mode for replacing the fusing device 25, hereinafter described with FIGS. 17 and 18, and the printer 1 terminates this flow of steps.

Figure 16:
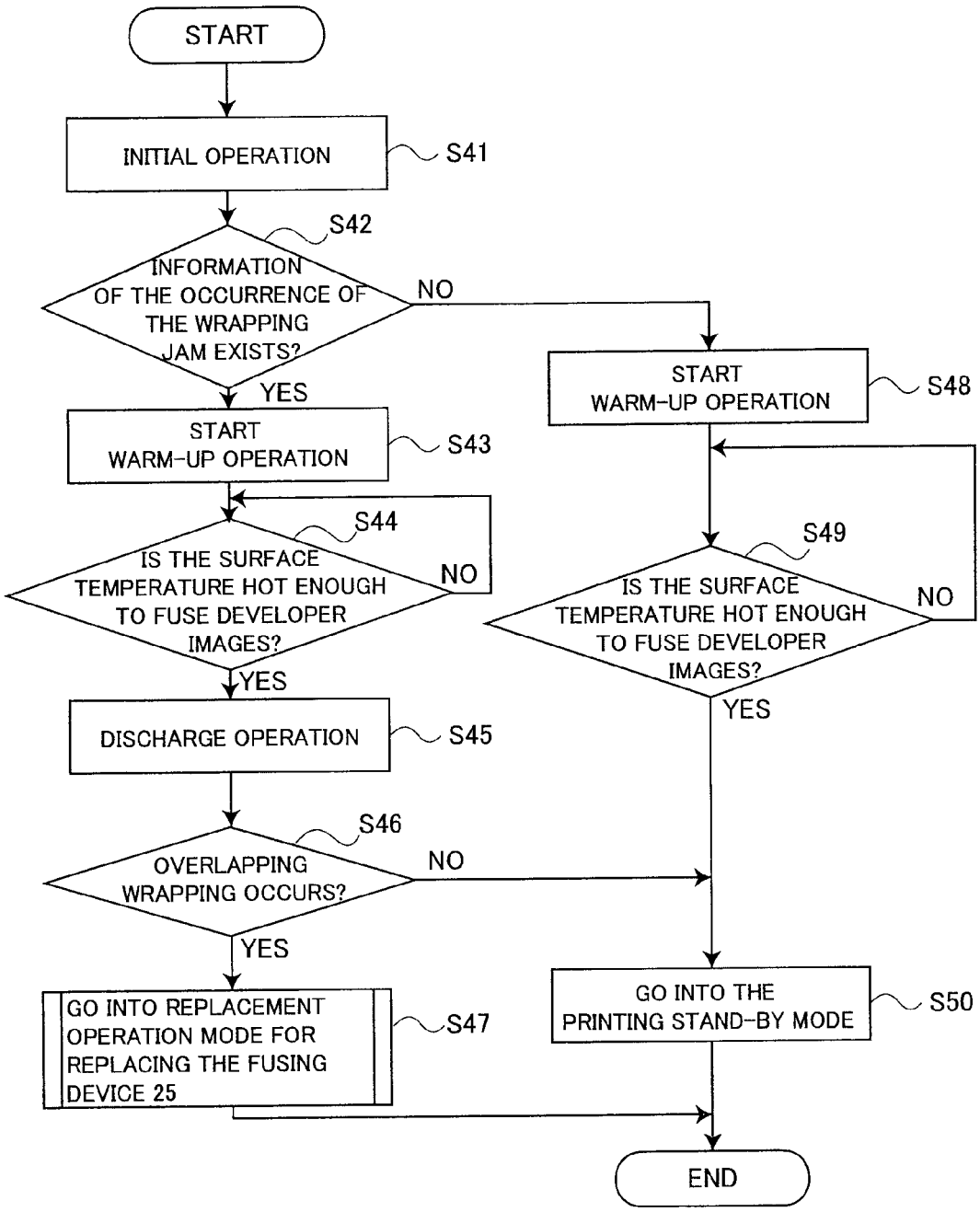
FIG. 16 is a flow chart of operation of the image forming apparatus.

Operation of the printer 1 where wrapping occurs at power-on of the printer 1 is hereinafter described with reference to FIG. 16. Such situation may occur if the user turns off the printer 1 without knowing the occurrence of wrapping and the like.

The printer starts to execute a series of operation upon power-on, and executes a power-on initial operation at step S41.

Subsequently at step S42, the printer 1 determines whether the information of the occurrence of wrapping jam exists. Specifically, the CPU69 looks up the ROM 71 to search the information of the occurrence of wrapping jam. Where the information of the occurrence of wrapping jam exists in the ROM 71, the printer 1 executes operation of step S43 and subsequent steps.

At step 43, the printer 1 starts the warm-up operation as described above. Subsequently, the printer 1 determines whether the surface temperature of the fusing roller 29 reaches the temperature at which the developer image can be fused. The printer 1 repeats such operation until the surface temperature of the fusing roller 29 reaches the temperature at which the developer image can be fused. Then, the printer 1 executes the paper discharge operation at step S45. Thereafter, the printer 1 determines whether the overlapping wrapping occurs at step S46.

As described above, where the information of the occurrence of wrapping jam exists, the printer 1 executes the discharge operation to detect whether the overlapping wrapping jam occurs. Where the printer 1 determines the occurrence of overlapping wrapping, the printer 1 proceeds to step S47 to go into a replacement operation mode of the fusing device 25, hereinafter described with reference to FIGS. 17 and 18, and terminates this flow of steps.

On the other hand, where the printer 1 determines that the information of the occurrence of wrapping jam does not exist at step S42, the printer 1 assumes that no abnormality exists, and proceeds to step S48 to execute the warm-up operation.

Thereafter, the printer 1 waits until the fusing roller 29 reaches the temperature at which the developer image can be fused at step S49, enters into the printing standby mode at step S50, and terminates this flow of steps. Herein, the printer 1 is configured to proceed to step S50 where the printer 1 determines that the overlapping wrapping does not occur at step S46. However, where a sheet is already wrapping around the fusing roller 29, the wrapped sheet is most likely to further wrap around the fusing roller 29 to result in overlapping wrapping. That is, the printer hardly proceeds to step S50 to go into the printing standby mode with a sheet wrapped around the fusing roller 29, and thus, this flow of steps practically causes no problem.

The replacement mode of the fusing device 25 is hereinafter described with reference to FIGS. 17 and 18.

For example, where a sheet of the paper P overlappingly wraps around the fusing roller 29, it is difficult to separate the sheet from the fusing roller 29, and moreover, even if the sheet can be successfully separated, the surface of the fusing roller 29 would be damaged. In such a case, the user has to replace the fusing device 25 with an unused fusing device. For convenience sake, a series of steps is hereinafter described including operations performed by the user.

The printer 1 halts the drive motor 59 at step S51, thereby halting the movement of each unit making up the printer 1. Simultaneously with this, the printer 1 de-energize the heater 27. Then, the printer 1 informs the user of the occurrence of overlapping wrapping jam via the display unit 63 at step S52. The printer 1 stores the information of the occurrence of overlapping wrapping jam in the ROM 71 at step S53. Then, the printer 1 displays an instruction to turn off the printer 1 and to replace the fusing device 25 on the display unit 63 at step S54.

Accordingly, the user turns off the printer 1 at step S55. Subsequently, the user replaces the fusing device 25 with an unused fusing device at step S56. Then, the user turns on the printer 1 at step S57.

When the user turns on the printer 1, the printer 1 starts an initial operation at step S58.

Subsequently, the printer 1 determines whether the fusing device 25 is unused at step S59. Methods for determining whether the fusing device 25 is unused includes using an RFID (Radio Frequency Identification) element to communicate with the unused determination unit 57 or electrically detecting blowout of a fuse in the fusing device 25.

If the fusing device 25 is determined to be an unused one, the printer 1 erases the information of the occurrence of overlapping wrapping jam from the ROM 71 at step S60. Subsequently, the printer 1 starts the warm-up operation at step S61, and performs the discharge operation at step S62.

At step S63, the printer 1 determines whether the overlapping wrapping occurs. If the printer 1 determines that the overlapping wrapping does not occur, the printer 1 enters into the printing standby mode at step S64, and terminates this flow of steps.

On the other hand, if the printer 1 determines that the overlapping wrapping occurs at step S63, the printer 1 repeats step S51 and its subsequent steps.

If the printer 1 determines that the fusing device 25 is not an unused one at step S59, the printer 1 displays an instruction to turn off the printer 1 and to replace the fusing device 25 on the display unit 63 at step S65.

In response to the instruction, the user turns off the printer 1 at S66, and performs step S56 and subsequent steps.

In this way, the printer 1 detects whether the paper P is remaining based on the temperature gradient GT and the time duration TC for which the temperature gradient GT continues, and thus, the printer 1 can accurately detect the remaining paper P without being influenced by spike noise occurring in a short time and the like.

Furthermore, the printer 1 can distinguish the occurrence of wrapping from the occurrence of overlapping wrapping and vice versa based on the relationship between the temperature gradient GT and the time duration TC. Thus, the printer 1 accurately informs the user of the cause of error to enable the user to easily cope with the error.

The second embodiment of the present invention is hereinafter described in details. The second embodiment is identical to the first embodiment with respect to some structures thereof, and accordingly, only different portions are hereinafter described in details. Specifically, a printer of the second embodiment is different from the printer 1 with respect to the way in detecting the temperature and calculating the temperature gradient, but is the same as the printer 1 with respect to operation and other structures. Therefore, only the detection of the temperature and the calculation of the temperature gradient are hereinafter described in details.

Figure 19:
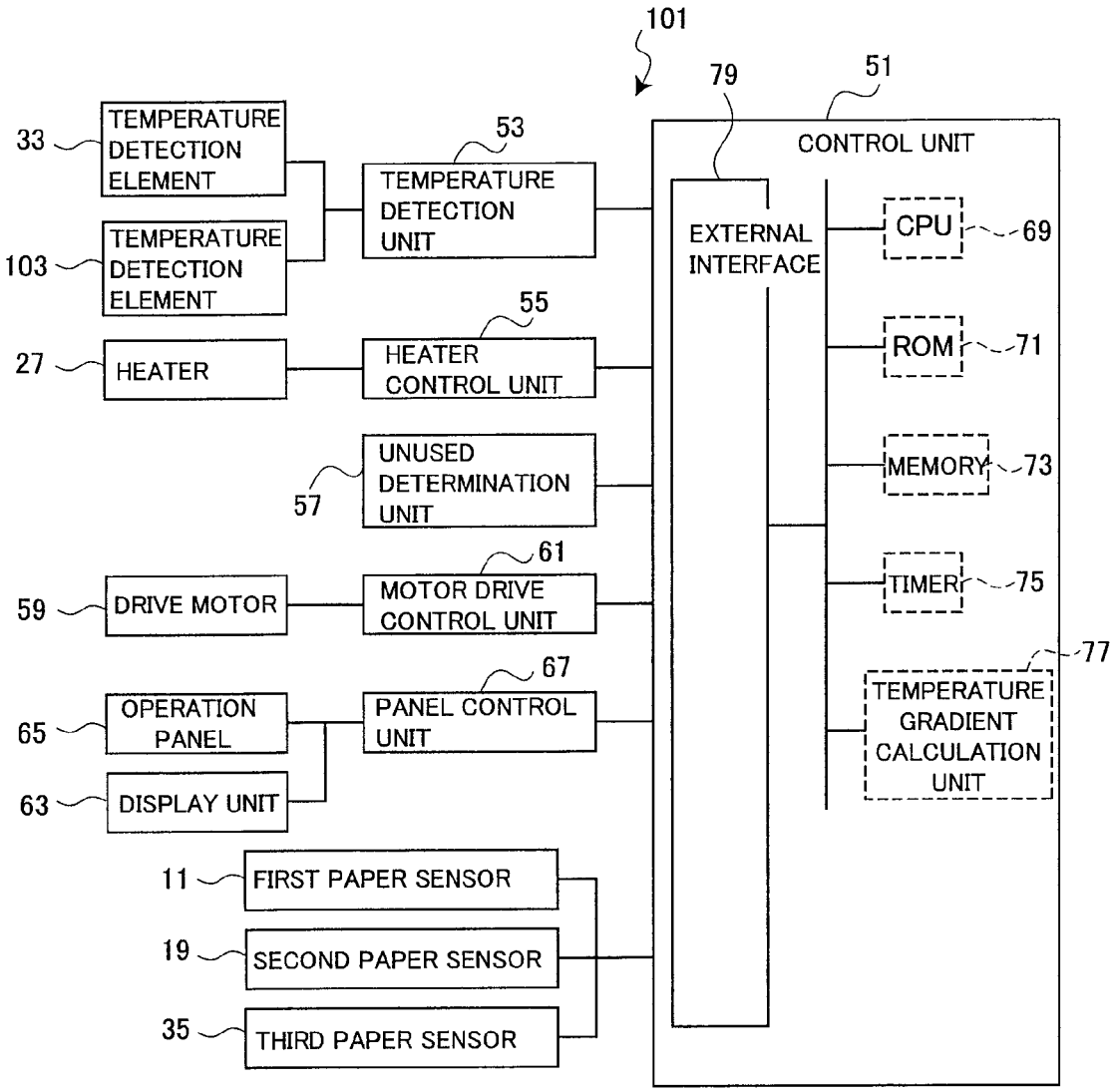
FIG. 19 is a block diagram of the image forming apparatus according to the second embodiment.

As shown in FIG. 19, a printer 101 of the second embodiment has a temperature detection element 103 as an ambient temperature detection unit detecting the ambient temperature in the fusing device 25.

Figure 20:
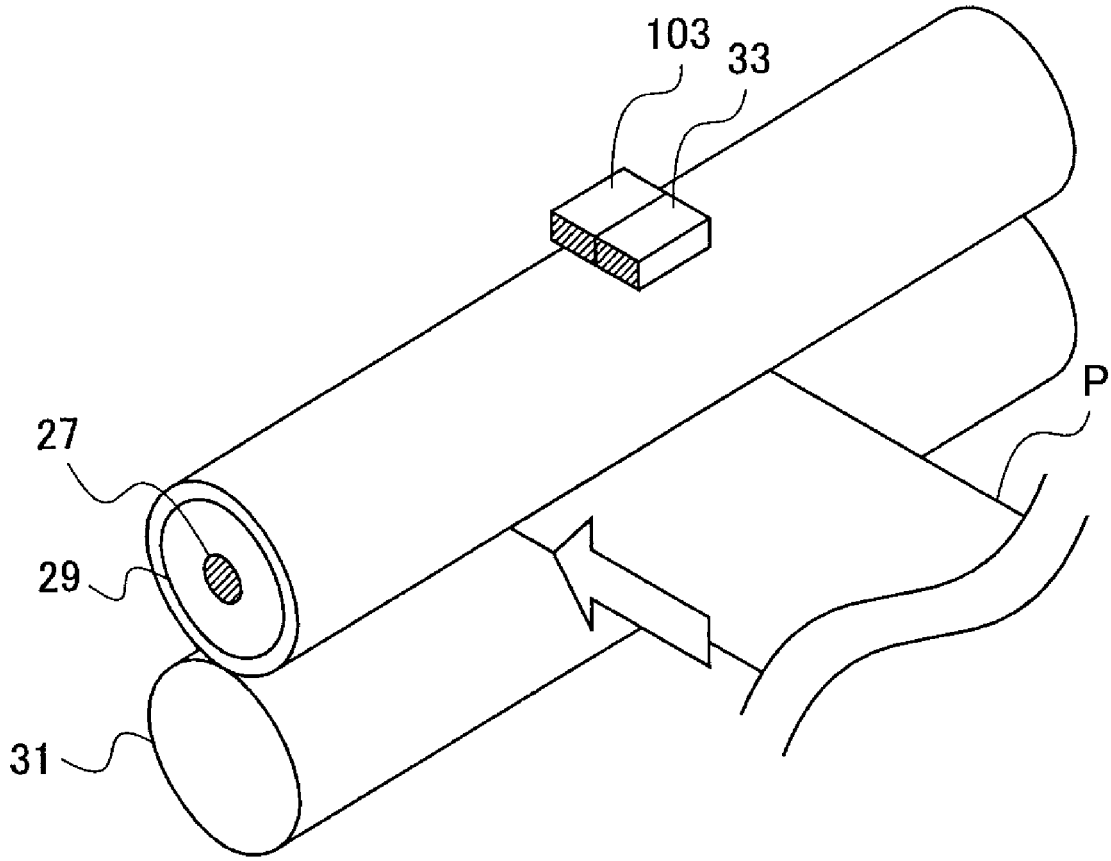
FIG. 20 is a perspective view of the essential portion of the fusing device of the image forming apparatus.
Figure 21:
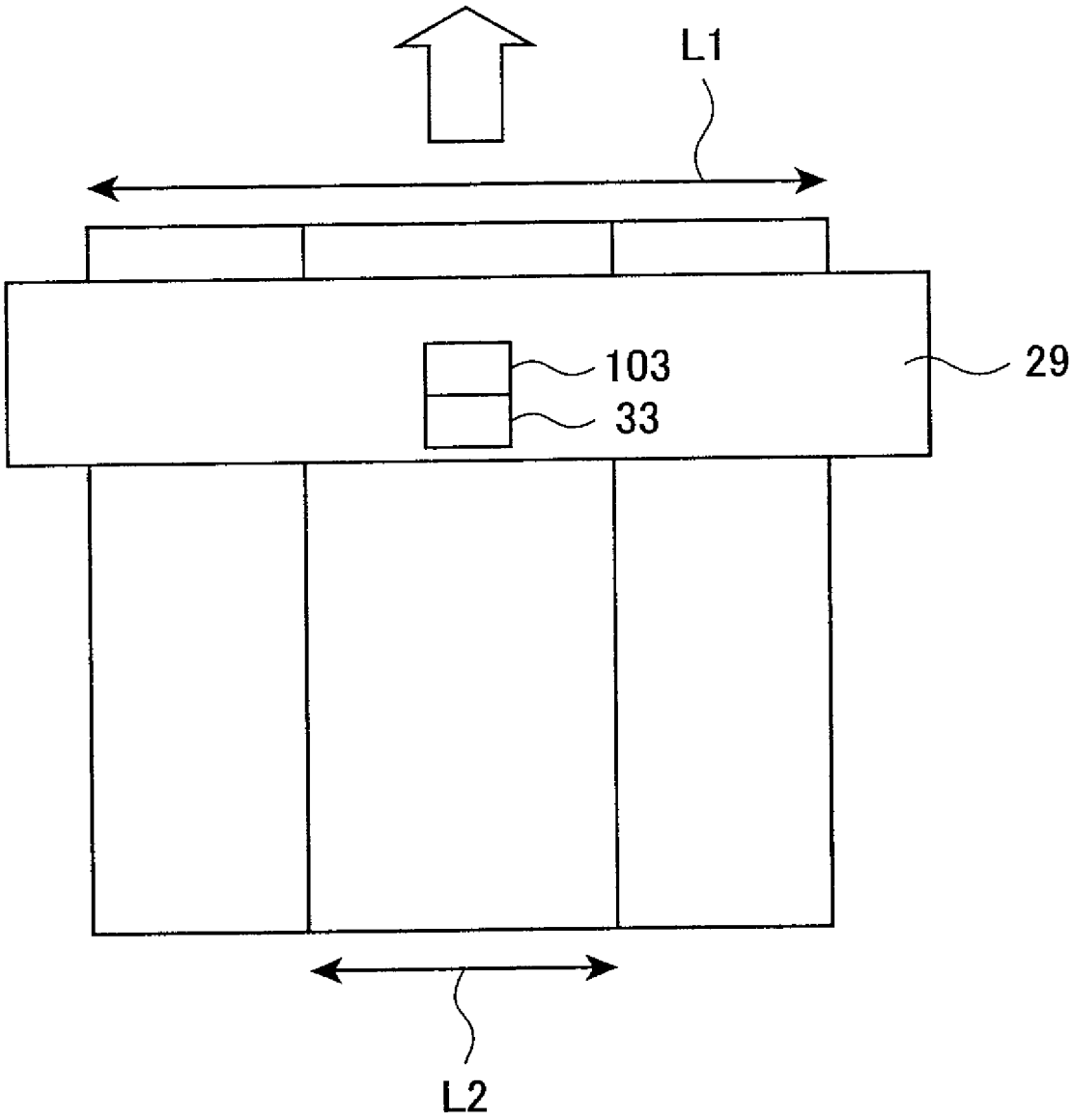
FIG. 21 is a top view of the fusing device.

The temperature detection element 103 detects the ambient temperature in the fusing device 25, and the detection result of the temperature detection element 103 is supplied to the control unit 51 via the temperature detection unit 53. The detection result of the temperature detection element 103 supplied to the control unit 51 is stored in the memory 73 just like the detection result of the temperature detection element 33. As shown in FIG. 20 and FIG. 21, the temperature detection element 103 is arranged adjacent to the temperature detection element 33 near the center of the maximum paper width L1 and the minimum paper width L2.

Figure 22:
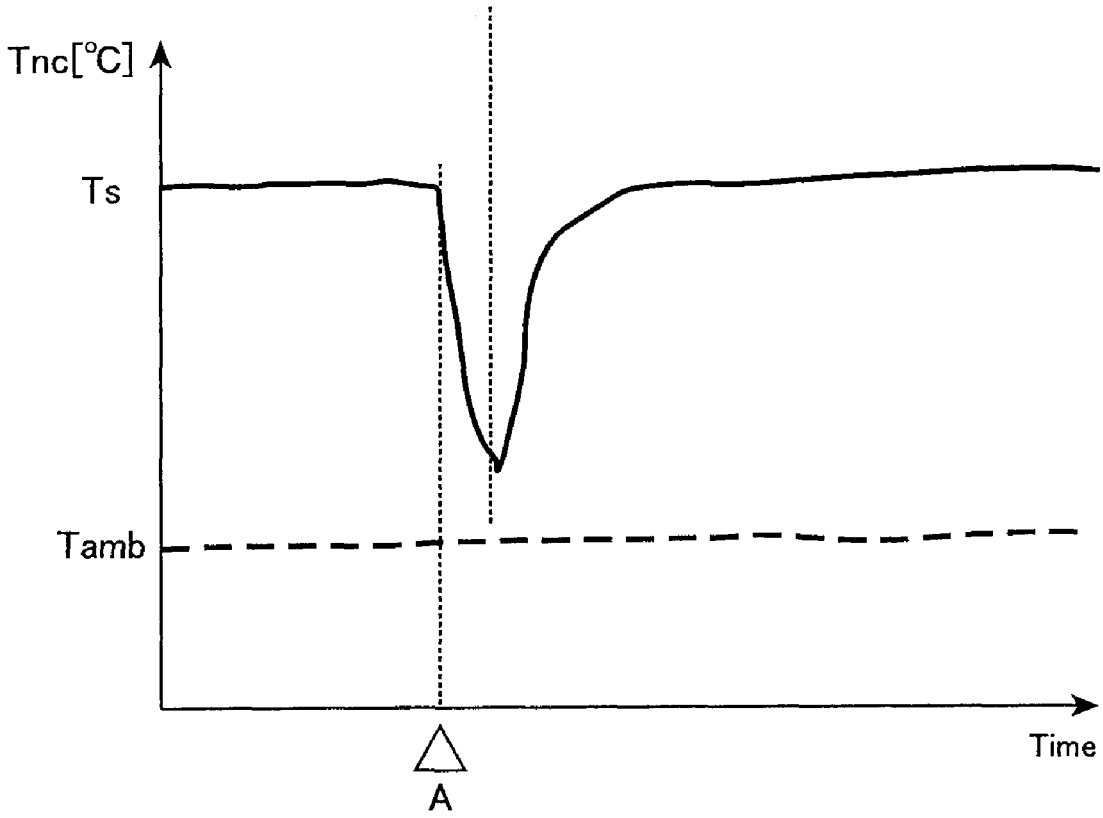
FIG. 22 is a profile of the surface temperature of the fusing roller inside the fusing device.

In the printer 101, the detected surface temperature Tnc of the fusing roller 29 detected by the temperature detection element 33 shows the fusing temperature Ts, and the ambient temperature in the fusing device 25 detected by the temperature detection element 103 shows the temperature Tamb as shown in FIG. 22. Before a time A, these temperatures are stable. Upon the occurrence of wrapping and temperature drop at time A, the detected surface temperature Tnc rapidly drops. However, the temperature around the fusing roller 29 in the fusing device 25 does not change, that is, the ambient temperature Tamb stays the same. Where the fusing roller 29 stops, the heat stored in the fusing roller 29 is released as described above and causes the detected surface temperature Tnc to increase, but the ambient temperature Tamb does not change.

Figure 23:
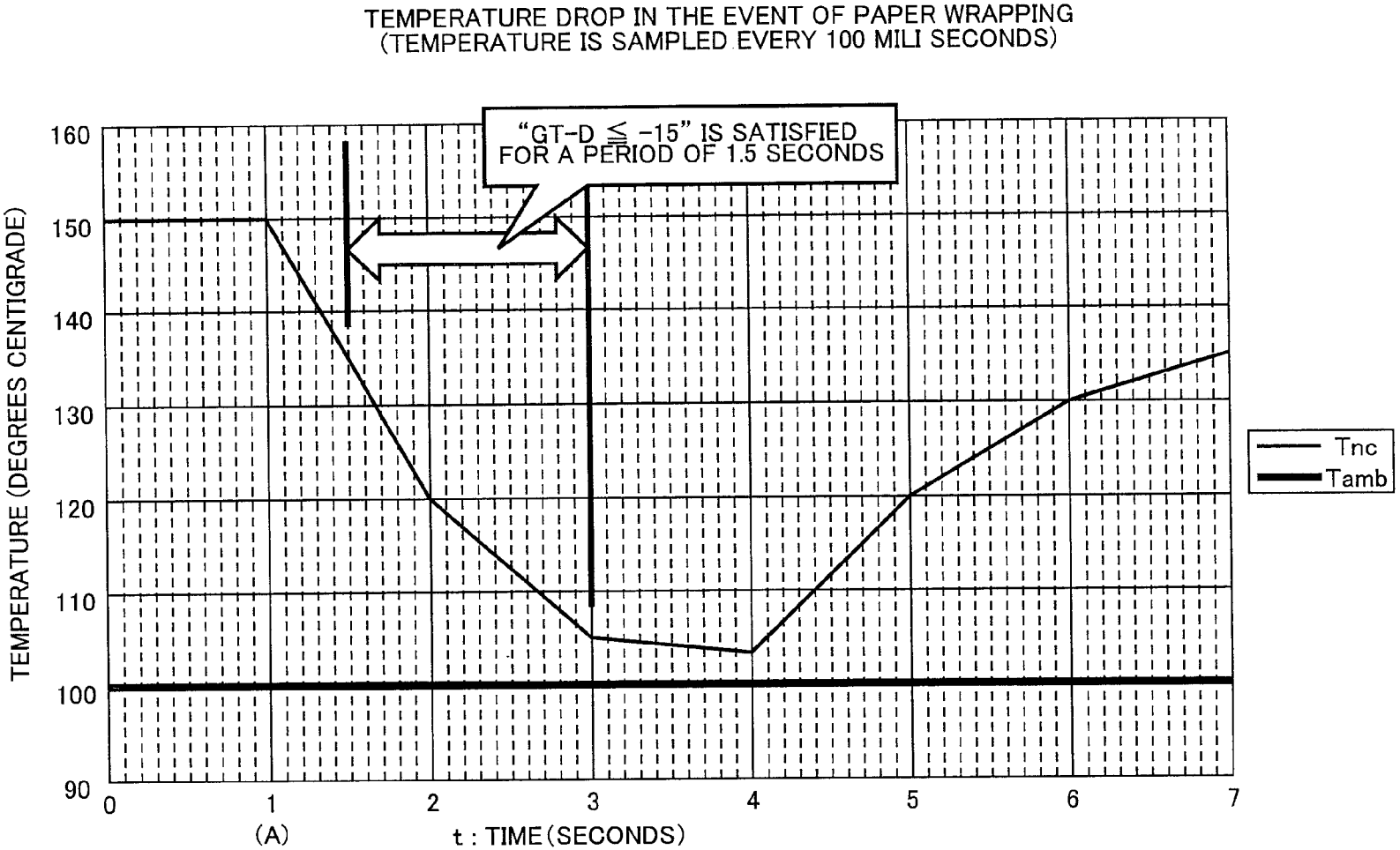
FIG. 23 is a profile of the surface temperature of the fusing roller inside the fusing device.

Referring to the detected surface temperature Tnc, the ambient temperature Tamb, and the time, it should be noted that the detected surface temperature Tnc shows a constant value 150 degrees Celsius and the ambient temperature Tamb shows a constant value 100 degrees Celsius before time A as shown in FIG. 23.

The temperature gradient calculation unit 77 calculates the temperature gradient based on the detected surface temperature Tnc and the ambient temperature Tamb. Specifically, the temperature gradient calculation unit 77 calculates the temperature gradient of the difference between the detected surface temperature Tnc and the ambient temperature Tamb. Where the temperature gradient GT-D of the difference between the detected surface temperature and the ambient temperature Tamb is defined as below:

$$GT\text{-}D = d(Tnc - Tamb)/dt \text{(degrees Celsius/second)},$$

a period exists for 1.5 seconds in which the below inequation is satisfied:

GT-D is smaller than or equal to −15(degrees Celsius/second).

Figure 24:
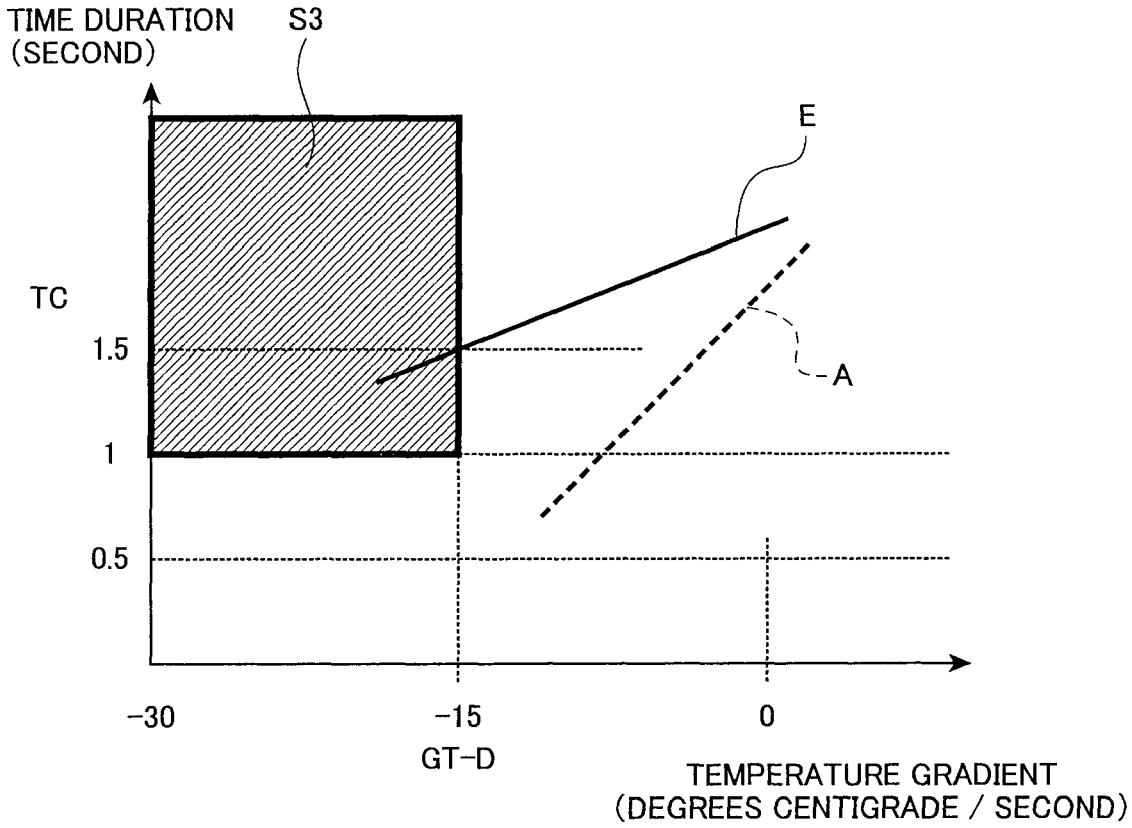
FIG. 24 is a chart showing relationship between the temperature gradient of the surface temperature of the fusing roller and the time duration.

The relationship between the temperature gradient GT-D and the time duration TC shows a relationship represented by line E in FIG. 24. As is evident from the chart, where the sheet wraps around the fusing roller, the temperature gradient GT-D becomes smaller (i.e., larger in absolute value) and the time duration becomes longer. The wrapping temperature gradient reference value (the first temperature gradient reference value) and the wrapping time duration reference value (the first time duration reference value) are previously calculated through experiment and are stored in the printer 1, for example, in the ROM 71 therein. The CPU 69 looks up the wrapping temperature gradient reference value and the wrapping time duration reference value, and determines the occurrence of wrapping where the temperature gradient GT-D is smaller and the time duration TC is longer than corresponding values during normal fusing operation.

Specifically, a wrapping occurring threshold area S3 with which line A does not overlap is previously defined in the chart showing the relationship between the temperature gradient GT-D and the time duration TC, and the printer 1 determines the occurrence of wrapping where line E overlaps the threshold area S3. In a case of the above example, the printer 1 sets the wrapping temperature gradient reference value to −15 degrees Celsius/second and sets the wrapping time duration reference value to 1 second, and the printer 1 determines the occurrence of wrapping where the temperature gradient is less than or equal to the wrapping temperature gradient reference value and the time duration is longer than or equal to the wrapping reference time.

Figure 25:
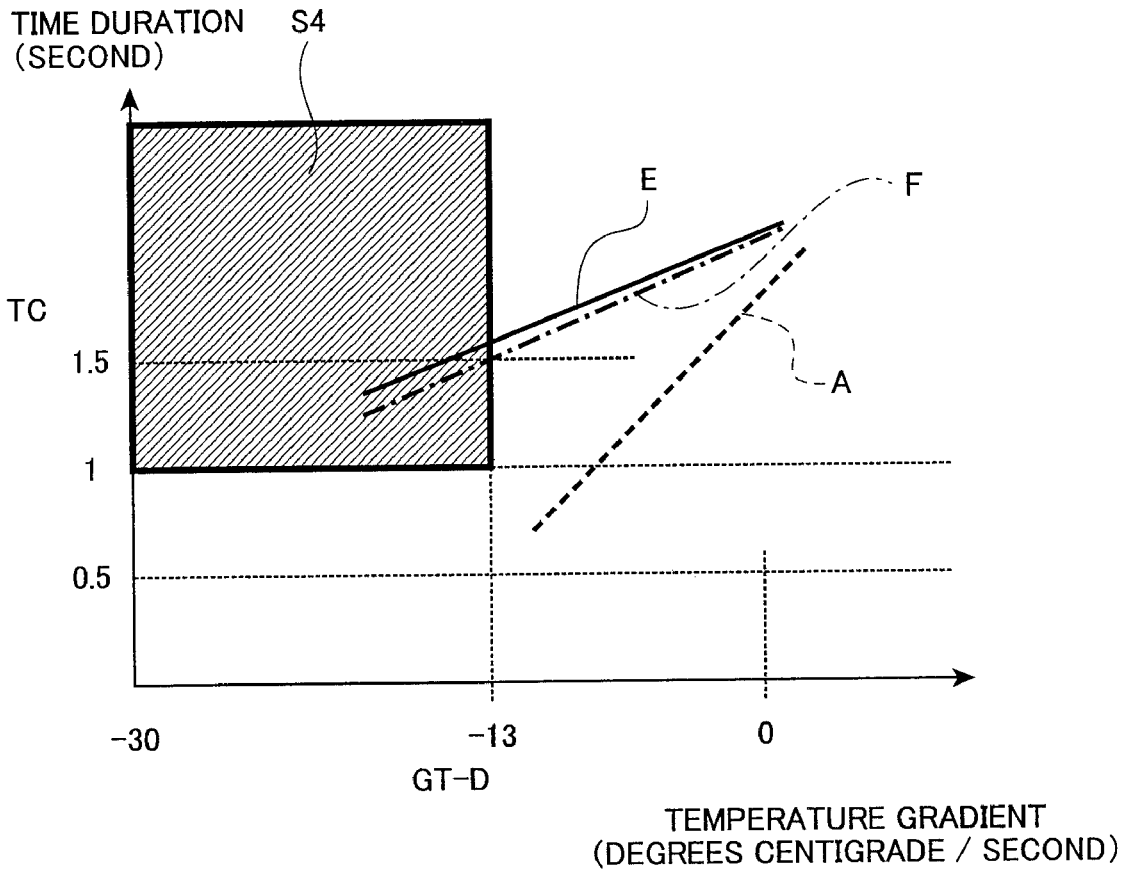
FIG. 25 is a chart showing relationship between the temperature gradient of the surface temperature of the fusing roller and the time duration.

The detected surface temperature Tnc when the overlapping wrapping occurs is sampled in a way similar to the above, and the relationship between the temperature gradient GT-D and the time duration TC is plotted in FIG. 25 as line F. Referring to the relationship between line A and line F, where the overlapping wrapping occurs, the temperature gradient GT-D becomes smaller (i.e., larger in absolute value) and the time duration becomes longer than in normal fusing operation. Considering the above, a threshold area S4 is defined in which the overlapping wrapping temperature gradient reference value (the second temperature gradient reference value) is less than or equal to −13 degrees Celsius/second and the overlapping wrapping time duration reference value (the second time duration reference value) is more than or equal to 1 second, and the printer 101 determines the occurrence of overlapping wrapping where both of these conditions are satisfied.

In this way, the printer 101 of the second embodiment detects whether the paper P is remaining while taking into consideration the ambient temperature in the fusing device 25, and thus, the printer 1 can accurately detect the remaining paper P without being influenced by spike noise occurring in a short time and the like.

Furthermore, the printer 101 can distinguish the occurrence of wrapping from the occurrence of overlapping wrapping and vice versa based on the relationship between the temperature gradient GT-D and the time duration TC. That is, the printer 101 can detect the occurrence of wrapping and the occurrence of overlapping wrapping while taking the ambient temperature into consideration, and can thus distinguish the occurrence of wrapping from the occurrence of overlapping wrapping and vice versa more accurately than the printer 1 regardless of situations in which the printer 101 is installed and change in temperature caused by other apparatuses. Thus, the printer 1 accurately informs the user of the cause of error to enable the user to easily cope with the error.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An image forming apparatus comprising:

a fusing unit fusing a developer image attached to a recording medium onto said recording medium with heat;

a heat source applying heat to said fusing unit;

a fusing temperature detection unit detecting a temperature of said fusing unit heated by said heat source;

a time measuring unit measuring a time duration;

a temperature gradient calculation unit calculating a temperature gradient value of change in the temperature of said fusing unit based on a detection result of the temperature of said fusing unit detected by said fusing temperature detection unit; and a remaining determination unit determining whether said recording medium remains in said fusing unit based on the temperature gradient value calculated by said temperature gradient calculation unit and the time duration of the temperature gradient value measured by said time measuring unit.

2. The image forming apparatus according to claim 1 further comprising an ambient temperature detection unit detecting an ambient temperature of said fusing unit heated by said heat source, wherein said temperature gradient calculation unit calculates the temperature gradient value based on the detection result of said fusing temperature detection unit and the detection result of said ambient temperature detection unit.

3. The image forming apparatus according to claim 1 further comprising a reference value memorizing unit storing a temperature gradient reference value for the temperature gradient value and a time duration reference value for the time duration, wherein said remaining determination unit determines whether said recording medium remains in said fusing unit based on a relationship between the temperature gradient value and the temperature gradient reference value stored in said reference value memorizing unit and a relationship between the time duration measured by the time measuring unit and the time duration reference value stored in the reference value memorizing unit.

4. The image forming apparatus according to claim 3, wherein said remaining determination unit determines that said recording medium remains in said fusing unit where the temperature gradient value is less than or equal to the temperature gradient reference value and the time duration is more than or equal to the time duration reference value.

5. The image forming apparatus according to claim 1 further comprising a reference value memorizing unit storing a first temperature gradient reference value for the temperature gradient value and a first time duration reference value for the time duration, wherein said remaining determination unit determines whether said recording medium wraps around said fusing unit based on a relationship between the temperature gradient value and the first temperature gradient reference value stored in said reference value memorizing unit and a relationship between the time duration measured by the time measuring unit and the first time duration reference value stored in the reference value memorizing unit.

6. The image forming apparatus according to claim 5, wherein said remaining determination unit determines that said recording medium wraps around said fusing unit where the temperature gradient value is less than or equal to the first temperature gradient reference value and the time duration is more than or equal to the first temperature gradient reference value.

7. The image forming apparatus according to claim 5, wherein said reference value memorizing unit stores a second temperature gradient reference value larger than the first temperature gradient reference value and a second time duration reference value, wherein said remaining determination unit determines whether said recording medium overlappingly wraps around said fusing unit based on a relationship between the temperature gradient value and the second temperature gradient reference value stored in said reference value memorizing unit and a relationship between the time duration measured by the time measuring unit and the second time duration reference value stored in the reference value memorizing unit.

8. The image forming apparatus according to claim 7, wherein said remaining determination unit determines that said recording medium overlappingly wraps around said fusing unit where the temperature gradient value is less than or equal to the second temperature gradient reference value and the time duration is more than or equal to the second temperature gradient reference value.

9. An image forming apparatus comprising a fusing device, the fusing device comprising:

a fusing unit fusing a developer image formed on a medium;

a temperature detector detecting a temperature of the fusing unit; and a calculation unit calculating a temperature ramp rate of the temperature of the fusing unit detected by the temperature detector;

wherein where the temperature ramp rate is less than or equal to a first threshold value for a prescribed period of time, the image forming apparatus determines that the medium wraps around the fusing unit and stops operation of the fusing device.

10. The image forming apparatus according to claim 9, wherein a second threshold value is more than the first threshold value, and wherein where the temperature ramp rate is less than or equal to a second threshold value for the prescribed period of time, the image forming apparatus determines that the medium overlappingly wraps around the fusing unit and stops the fusing unit.

11. An image forming apparatus comprising a fusing device, the fusing device comprising:

a fusing unit fusing a developer image formed on a medium;

a temperature detector detecting a temperature of the fusing unit;

an ambient temperature detector detecting an ambient temperature around the fusing unit; and a calculation unit calculating a temperature ramp rate of a differential temperature between the temperature of the fusing unit detected by the temperature detector and the ambient temperature detected by the ambient temperature detector, wherein where the temperature ramp rate is less than or equal to a first threshold value for a prescribed period of time, the image forming apparatus determines that the medium wraps around the fusing unit and stops operation of the fusing device.

12. The image forming apparatus according to claim 11, wherein where the temperature ramp rate is less than or equal to a second threshold value larger than the first threshold value for the prescribed period of time, the image forming apparatus determines that the medium overlappingly wraps around the fusing unit and stops the fusing unit.

* * * * *